US005689292A

United States Patent [19]

Suzuki et al.

[11] Patent Number: 5,689,292

[45] Date of Patent: Nov. 18, 1997

[54] MULTI-STEP HEATING OF A RECORDING HEAD

[75] Inventors: Naohisa Suzuki, Yokohama; Kazuhisa Kawakami, Kawasaki; Junichi Yoshikawa, Tokyo, all of Japan

[73] Assignee: Canon Kabushiki Kaisha, Tokyo, Japan

[21] Appl. No.: 665,771

[22] Filed: Jun. 18, 1996

Related U.S. Application Data

[63] Continuation of Ser. No. 967,390, Oct. 28, 1992, abandoned, which is a continuation-in-part of Ser. No. 744,704, Aug. 13, 1991, Pat. No. 5,307,093.

[30] Foreign Application Priority Data

| | | | |
|---|---|---|---|
| Aug. 14, 1990 | [JP] | Japan | 2-214646 |
| Aug. 14, 1990 | [JP] | Japan | 2-214647 |
| Aug. 14, 1990 | [JP] | Japan | 2-214648 |
| Aug. 14, 1990 | [JP] | Japan | 2-214649 |
| Oct. 29, 1991 | [JP] | Japan | 3-282416 |

[51] Int. Cl.[6] ..... B41J 2/05

[52] U.S. Cl. ..... 347/17; 347/14; 347/60; 347/186

[58] Field of Search ..... 347/17, 14, 60, 347/185, 186

[56] References Cited

U.S. PATENT DOCUMENTS

| | | | |
|---|---|---|---|
| 4,791,435 | 12/1988 | Smith et al. | 347/17 |
| 5,109,234 | 4/1992 | Otis et al. | 347/14 |
| 5,177,499 | 1/1993 | Yoshida et al. | 347/186 |
| 5,191,357 | 3/1993 | Ono | 347/186 |
| 5,262,799 | 11/1993 | Ono et al. | 347/186 |
| 5,307,093 | 4/1994 | Suzuki et al. | 347/17 |

FOREIGN PATENT DOCUMENTS

| | | | |
|---|---|---|---|
| 61-049867 | 3/1986 | Japan | B41J 2/38 |

*Primary Examiner*—Joseph W. Hartary

*Attorney, Agent, or Firm*—Fitzpatrick, Cella, Harper & Scinto

[57] ABSTRACT

A recording apparatus for recording an image on a recording material includes a heat generating element for controlling a temperature of a recording head, a driver for driving the heat generating element to generate heat, and control circuitry for controlling the driver to generate heat from the heat generating element with plural steps with a predetermined heat generating period, after completion of a recording operation by the recording head.

32 Claims, 27 Drawing Sheets

INITIAL HEAT

| WAIT TIME/RANK | 4 | 3 | 2 | 1 | 0 |
|---|---|---|---|---|---|
| 3sec | —— | 0.13sec | 0.19sec | 0.25sec | 0.30sec |

FIG. 13A

PRE-HEAT

| WAIT TIME/RANK | 4 | 3 | 2 | 1 | 0 |
|---|---|---|---|---|---|
| 0 ~ 4sec | —— | —— | —— | —— | —— |
| 4~10sec | —— | —— | —— | 0.20sec | 0.20sec |

FIG. 13B

LINE HEAT (DRAFT MODE)

| PRINT TIME/RANK | 4 | 3 | 2 | 1 | 0 |
|---|---|---|---|---|---|
| 0 ~ 60sec | —— | 16ms | 16ms | 24ms | 24ms |
| 60~120sec | —— | 8ms | 16ms | 16ms | 24ms |
| 120 360sec | —— | 8ms | 8ms | 16ms | 16ms |
| >360sec | —— | —— | 8ms | 8ms | 16ms |

FIG. 13C

LINE HEAT (FINE MODE)

| PRINT TIME/RANK | 4 | 3 | 2 | 1 | 0 |
|---|---|---|---|---|---|
| 0 ~ 60sec | —— | 24ms | 24ms | 32ms | 48ms |
| 60~120sec | —— | 16ms | 16ms | 24ms | 32ms |
| 120~360sec | —— | 16ms | 16ms | 16ms | 24ms |
| >360sec | —— | 8ms | 8ms | 16ms | 24ms |

FIG. 13D

DUTY HEAT

| WAIT TIME/RANK | 4 | 3 | 2 | 1 | 0 |
|---|---|---|---|---|---|
| 6sec | —— | 0.13sec | 0.19sec | 0.25sec | 0.30sec |

FIG. 13E

FIG. 18A

INITIAL HEAT (V=18V)

| TEMP RANK | 4 | 3 | 2 | 1 | 0 |
|---|---|---|---|---|---|
| TEMP | ≧21°C | 21~18°C | 18~16°C | 16~14°C | ≦14°C |
| | ------ | 1300ms | 2000ms | 2500ms | 3000ms |

FIG. 18B

PRE-HEAT (V=18V)

| WT/TEMP | ≧21°C | 21~18°C | 18~16°C | 16~14°C | ≦14°C |
|---|---|---|---|---|---|
| 0~4ses | ------ | 32ms | 48ms | 96ms | 96ms |
| 4~6ses | ------ | 200ms | 296ms | 400ms | 400ms |

FIG. 18C

LINE HEAT (V=18V)

| PT/TEMP | ≧21°C | 21~18°C | 18~16°C | 16~14°C | ≦14°C |
|---|---|---|---|---|---|
| 0~360sec | ------ | 16ms | 16ms | 24ms | 24ms |
| ≧360sec | ------ | 8ms | 8ms | 16ms | 24ms |

FIG. 18D

INTERVAL HEAT (V=18V)

| PT/TEMP | ≧21°C | 21~18°C | 18~16°C | 16~14°C | ≦14°C |
|---|---|---|---|---|---|
| 0~360sec | ------ | 32ms | 32ms | 40ms | 40ms |
| ≧360sec | ------ | 16ms | 16ms | 32ms | 40ms |

FIG. 18E

DUTY HEAT (V = 8V)

| | TEMP | ≧21°C | 21~18°C | 18~16°C | 16~14°C | ≦14°C |
|---|---|---|---|---|---|---|
| H. DUTY HEAT | PT=0 & n≦180 | ------ | 1170ms | 1940ms | 4100ms | 5840ms |
| L. DUTY HEAT | PT≠0 OR 180<n | ------ | 730ms | 1170ms | 1750ms | 2260ms |

(V=18V)

| | TEMP | ≧21°C | 21~18°C | 18~16°C | 16~14°C | ≦14°C |
|---|---|---|---|---|---|---|
| L. DUTY HEAT | | ------ | 128ms | 192ms | 248ms | 296ms |

MULTI-STEP HEATING OF A RECORDING HEAD

This application is a continuation of application Ser. No. 07/967,390 filed Oct. 28, 1992, now abandoned which is a continuation-in-part of application Ser. No. 07/744,704 filed Aug. 13, 1991 now U.S. Pat. No. 5,307,093.

FIELD OF THE INVENTION AND RELATED ART

The present invention relates to a recording apparatus and a recording method using the same, more particularly to a apparatus and method having an ink jet type recording head provided with a temperature keeping heater controlling the temperature of the recording head.

Recently, the recording apparatus, particularly a recording head, of an ink jet recording type, are manufactured through a film forming technique or a microprocessing technique as in a semiconductor device manufacturing, so that the cost and the size thereof are reduced. By such a recording head manufacturing process, it is possible to provide on one silicon chip having electrothermal transducer elements (heaters) as heat generating elements for ejection of the ink, transistors and diodes constituting switching elements or the like for driving the heater and wiring among these elements.

In view of this, a recording apparatus has been provided in which both of the ink ejection heaters and the temperature keeping heaters are formed on one chip.

On the other hand, since it is now possible to manufacture small recording heads at low cost, a recording apparatus having a replaceable type recording head integrally having an ink container, has been developed. Such a small size and low cost recording apparatus is used with a wordprocessor, an electronic typewriter, a copying machine, a facsimile machine or the like.

In such a recording apparatus or an apparatus using it as the recording means, it is one of the trends that the size and the cost thereof are reduced. From this standpoint, it is desired that the structure for the temperature control for the recording head using heating and temperature keeping heaters is simple and small in size and low in cost.

As for the control systems for the temperature control using the temperature keeping heater, the following are known:

(1) A temperature sensor provided in a recording head and a temperature keeping heater are used, and the heater is continuously supplied with a voltage to effect a closed loop control;

(2) A temperature sensor outside the recording head and a temperature keeping heater are used, and the heater is continuously supplied with a voltage to effect an open-loop control; and (3) A temperature sensor outside the recording head and a temperature keeping heater are used, and the heater is supplied with a pulsewise voltage to effect a closed loop control (U.S. Ser. No. 585,924 filed on Sep. 18, 1990).

Of these systems, system (1) requires complicated and expensive heater driving systems, and in addition, the direct detection of the recording head requires the temperature sensor to sense small temperature changes, and therefore, a relatively high accuracy is required. System (2) also requires complicated and expensive heater driving systems.

System (3) is advantageous in that the heater driving circuit may have a relatively simple structure, and that the control operation is easy. The following gives examples of the control systems for the temperature keeping heater (sub-heating) for the above system (3):

(1) Initial heating, which is a first heating operation carried out during initializing operation after actuation of a main switch;

(2) Preheating, which is a preliminary heating operation carried out in response to print starting instructions after a waiting period;

(3) Line heating is carried out for every line printing; and (4) Interval heating is carried out during the waiting period after completion of the printing.

The time required for the preheating is relatively long. Since the preheating is carried out prior to the printing operation moving the carriage, for example, the user feels that the time between the printing instruction and the actual start of the printing is long.

In order to effect the four sub-heating control operations for the head temperature controlling system (3) described above, both a printing period measuring means for measuring an integrated printing period and a waiting period measuring means for measuring the print-waiting period after the completion of the printing are required. The methods for the measurement include a method in which respective timers are provided to measure the respective times and a method wherein one timer for producing a relatively long constant time period, a printing counter and a wait counter are used, and the counters are counted up at the timing on the basis of the constant time period produced by the timer, so that the times are measured. Either case requires at least one timer.

A wordprocessor, a typewriter or the like having an integral recording device of the above time as the printing means and having key input means, an additional timer is required exclusively for generating timing for receiving key input information.

Thus, the conventional time measuring means requires a plurality of timers with the result of difficulty in reducing the cost and in simplifying the structure.

As regards the temperature measurement, a timer is required exclusively for providing detection timing at the regular intervals, and in addition, errors are involved in the detection system and in conversion of the measurement to a temperature range signal or to a digital signal using an A/D converter or the like. Then, an additional timer is required to smooth and remove the variation with the result of complicated structure.

It is effective from the standpoint of simplification of the apparatus structure to use the driving source for the sub-heat for the temperature keeping also as another driving source. For example, a carriage driving source is considered since which is possibly used during the sub-heat drive. The carriage may be moved in two modes providing different carriage movement speeds, and at the lower speed, a fine mode printing is effected in one way printing, and at the higher speed, a draft printing mode is effected in bi-directional printing.

In order to increase the carriage movement speed, the driving source is required to be increased in order to increase the torque of the carriage motor. Therefore, if the carriage driving source is used also as the sub-heat driving source, the energy generated for the sub-heat drive changes with the carriage movement speed. Conventionally, therefore, the carriage drive responsive to the mode selection and the sub-heat drive are effected by different driving sources.

As described in the foregoing, it is considered that the initial heating operation or the pre-heating operation is carried out for the ink ejection portion of the recording head having a low temperature as in the case immediately after the main switch of the apparatus is actuated, so that the temperature of the recording head is increased. However, the initial heating and the pre-heating operations apply one pulse to heat the recording head with the result that in order to sufficiently heat the recording head by the pulse, a long term pulse is required. When a long term pulse is applied, the temperature in the neighborhood of the heating and temperature keeping heater is locally increased to a very high extent, and therefore, a large thermal stress is produced in the heater containing chip due to the thermal gradient. Such an initial heating operation is carried out immediately after the main switch of the apparatus is actuated. If the long term pulse is applied at all times for the initial heating and when the user repeats actuation and deactuation of the main switch, the temperature of the recording head is increased to an extreme extent. If it exceeds a critical point, there is a liability that the recording head is damaged.

In order to avoid these problems, it would be considered that the energy applied to the recording head during the initial heating and pre-heating operation, is decreased to prevent the damage of the recording head even if the above repeated actuation and deactuation are performed. However, if this is done, the temperature rise in the neighborhood of the ejecting portions of the recording head which is the original object of the initial heating operation, is not sufficient.

SUMMARY OF THE INVENTION

Accordingly, it is a principal object of the present invention to provide an ink jet recording apparatus, method and system in which the temperature of the recording head can be controlled to be a desired temperature.

It is another object of the present invention to provide an ink jet recording apparatus, system and method in which the initial temperature rise after actuation of the main switch can be provided sufficiently and safely.

According to an aspect of the present invention, there is provided a recording apparatus for recording an image on a recording material, comprising: a heat generating element for controlling a temperature of the recording head; driving means for driving said heat generating element to generate heat; and control means for controlling said driving means to generate heat from said heat generating element with plural steps with a predetermined heat generating period, after completion of recording operation of said recording head.

According to another aspect of the present invention, there is provided a recording apparatus for recording an image on a recording material, comprising: a heat generating element for controlling a temperature of a recording head; driving means for driving said heat generating element to generate heat; and control means for controlling said driving means to drive said heat generating element after actuation of a main switch of said recording apparatus and before start of recording operation thereof, to reduce energy applied to said heat generating element when a predetermined condition is satisfied and to generate the heat with a predetermined periods.

According to a further aspect of the present invention, there is provided a recording method for recording an image on a recording material, comprising the steps of: recording with a recording head; and heat generating steps which is carried out after said recording step and in which heat generating element for controlling the temperature of the recording head is actuated plural times with a predetermined period, wherein energy applied to said heat generating element in a later step is smaller than the energy applied to said heat generating element in an earlier step.

According to a further aspect of the present invention, there is provided a recording method for recording an image on a recording material, comprising the steps of: actuating a main switch of a recording apparatus; a first heat generating step which is carried out after actuation of the main switch and in which a heat generating element for controlling a temperature of the recording head is driven to generate heat before start of a recording operation; a second heat generating step in which energy applied to the heat generating element is made, when a predetermined condition is satisfied after said first heat generating step, lower than the energy applied to the heat generating element in said first heat generating step, and the heat generating element is driven with predetermined periods; and recording step for recording by a recording head after said first and second heat generating step.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 13A, 13B, 13C, 13D and 13E show tables for setting the heating period for various sub-heat operations in the sub-heat control operation.

FIGS. 18A, 18B, 18C, 18D and 18E show contents of sub-heat control data table in an electronic typewriter according to an embodiment of the present invention.

DESCRIPTION OF THE PREFERRED EMBODIMENTS

Referring to the accompanying drawings, the embodiments of the present invention will be described in detail.

Figure 1A:
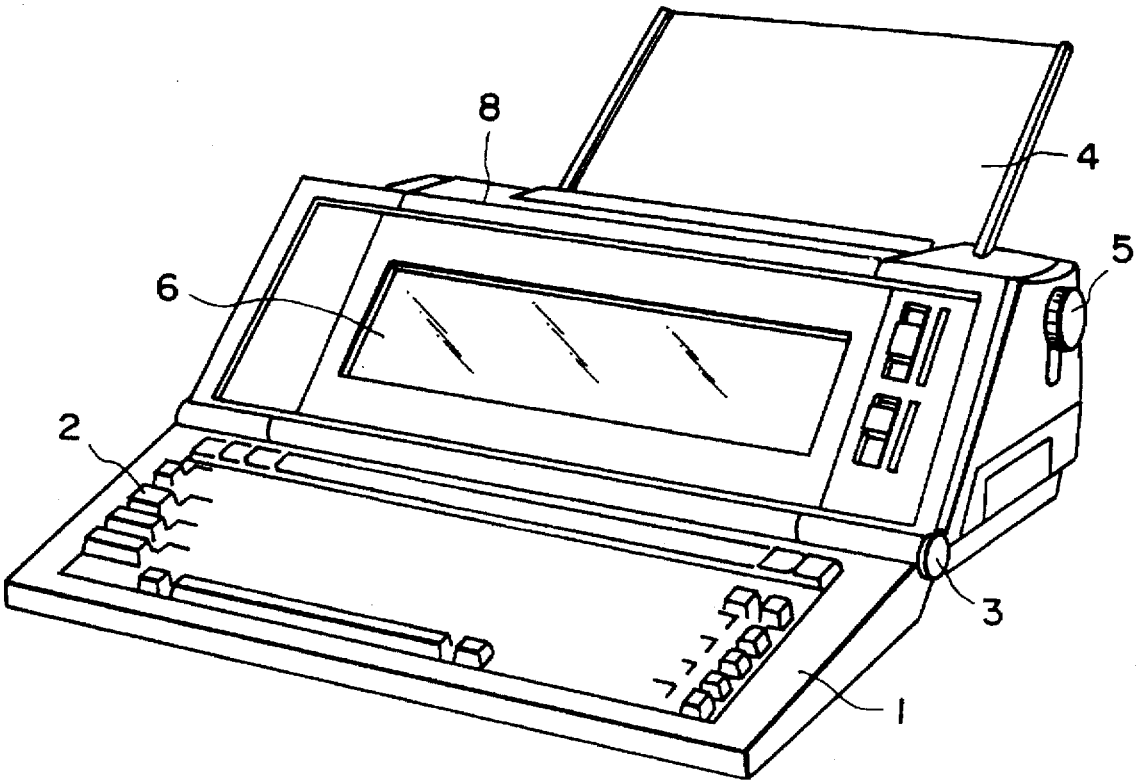
FIGS. 1A and 1B are perspective views of a recording apparatus in the form of an electronic typewriter according to an embodiment of the present invention, when it is used and when it is not used.
Figure 1B:
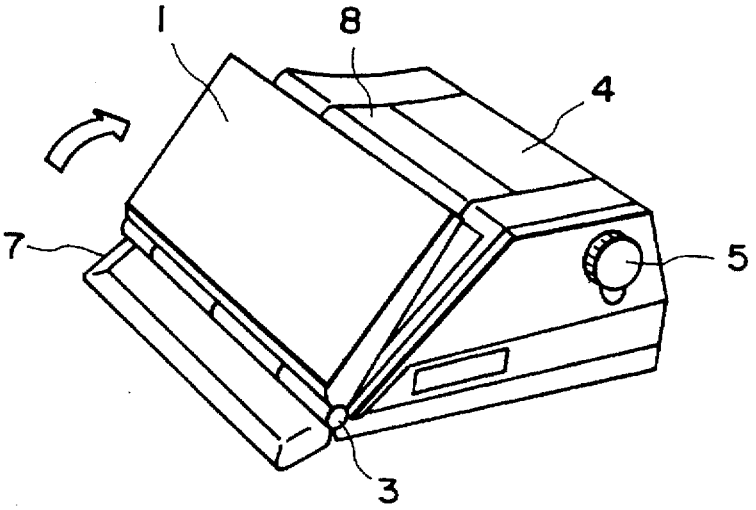

Referring to FIGS. 1A and 1B, there is shown an electronic typewriter to which the present invention is applicable.

It comprises a keyboard 1 having a group of keys such as, character keys, numerical keys, control keys or the like. The keyboard 1 is foldable by rotating about a hinge 3, as shown in FIG. 1B. A sheet feeding tray 4 accommodates recording mediums in the form of sheets to be supplied to the printer in the apparatus. When the apparatus is not used, the tray 4 is also foldable to cover the printer, as shown in FIG. 1B. The apparatus further comprises a sheet feeding knob 5 for permitting manual supply or discharge of the recording medium, a liquid crystal display (LID) for displaying input sentences or the like, and a grip 7 used when the apparatus is carried around.

Figure 2:
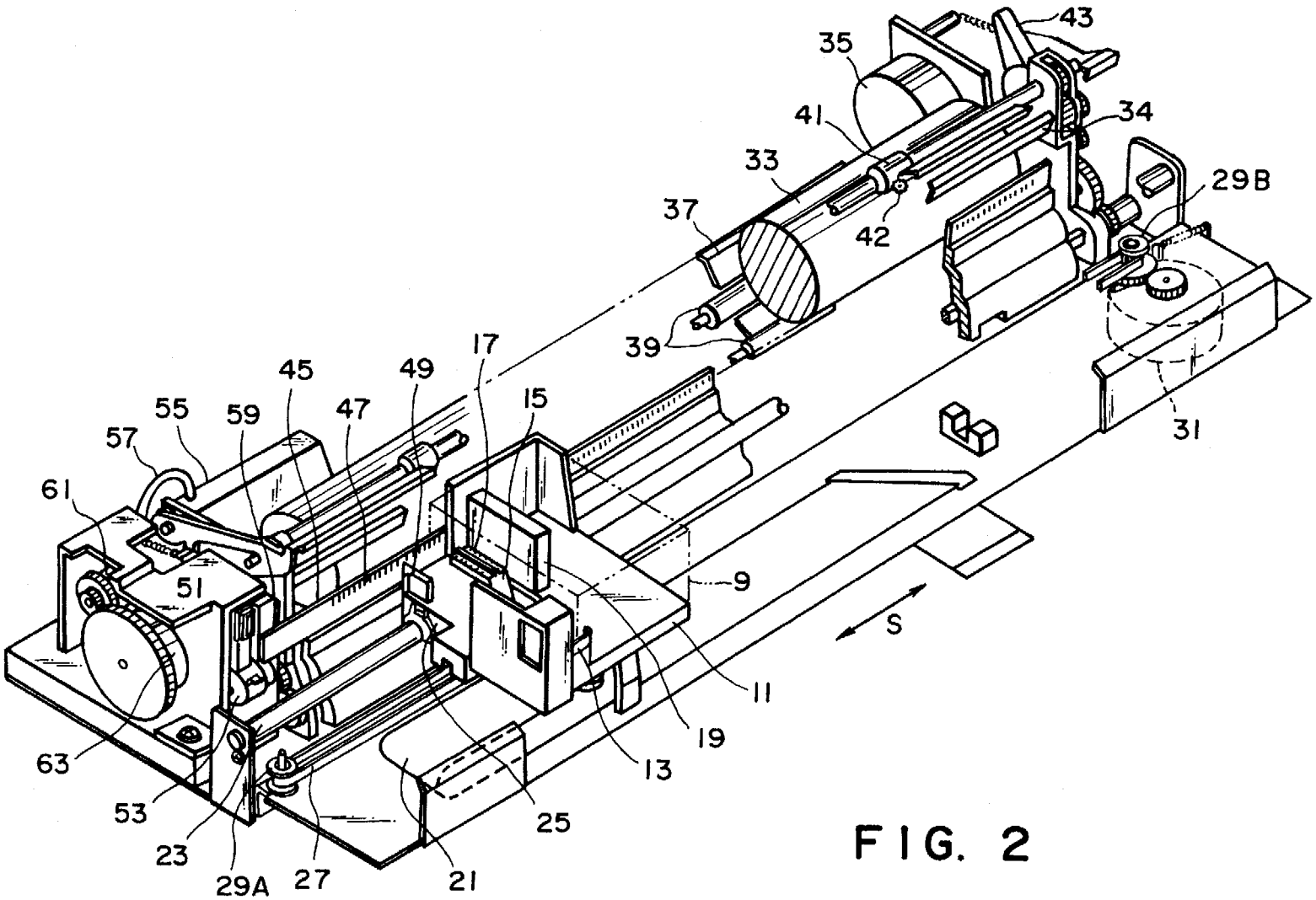
FIG. 2 is a perspective view of an example of a printer provided in the electronic typewriter of FIGS. 1A and 1B.

FIG. 2 shows the structure of the printer portion of the apparatus in this embodiment. It comprises a head cartridge 9 having an ink jet recording head which will be described in detail in conjunction with FIGS. 3 and 4, a carriage 11 for carrying the head cartridge 9 and moving it in a direction S (scan), a hook 13 for mounting the head cartridge 9 on the carriage 11, and a lever 15 for manipulating the hook 13. The lever 15 is provided with a marker 17 for indicating print position or set position of the recording head of the head cartridge, with the aid of scales on a cover which will be described hereinafter.

A supporting plate 19 supports electric connections relative to the head cartridge 9. A flexible cable 21 is used to electrically connect the electric connections with the controller of the main assembly of the apparatus.

A guiding shaft 23 guides the carriage 11 for the movement in the direction S and is supported by bearings 25. A timing belt 27 is fixed to the carriage 11 and transmits the driving power for the movement of the carriage 11 in the direction S and is stretched around pulleys 29A and 29B disposed at the lateral ends of the apparatus. To one 29B of the pulleys, the driving force is transmitted through transmission mechanism such as gear from a carriage motor (CM) 31.

A conveying roller 33 functions to confine the record surface of the recording medium (recording sheet) and also to feed the sheet during the recording operation or the like, and is driven by a sheet feeding motor (FM) 35. A paper pan 37 functions to lead the recording medium from the sheet feeding tray 4 to the recording position. A feed roller 39 is disposed in the sheet feeding passage and presses the recording medium to the conveying roller 33 to feed the recording medium. A platen 34 is effective to confine the surface to be recorded of the recording material and is faced to the ejection outlet side surface of the head cartridge 9. Sheet discharging rollers 41 are disposed downstream of the recording position with respect to the recording medium conveying direction to discharge the sheet. Spurs 42 are contacted to the sheet discharging rollers 41 to urge the recording medium to the rollers 41 to assist the discharging operation by the discharging rollers 41. A releasing lever 43 is provided to release the urging forces by the feeding roller 39, confining plates and the spurs 42 when the recording medium is set in the apparatus, for example.

The confining plate 45 prevents bulging of the recording medium adjacent the recording position to assure the close contact of the recording medium to the conveying roller 33. In this example, the recording head is in the form of an ink jet recording head which ejects the ink for the recording. Therefore, the distance between the ink ejection outlet side surface of the recording head and the surface to be recorded of the recording material is relatively small, but the contact between the recording medium and the ejection side surface should be avoided, and therefore, the clearance is relatively strictly controlled. From this standpoint, the use of the confining plate 45 is effective. The confining plate 45 is provided with scales 47 which are used with the aid of a marker 49 on the carriage 11. Using them, the printing position and the set position of the recording head are known, too.

A cap 51 is faced to the ejection outlet side surface of the recording head at its home position and is made of elastic material such as rubber. It is supported for contact to and separation from the recording head. The cap 51 is used to protect the recording head when the recording operation is not carried out, and is also used when a ejection recovery operation for the recording head is carried out. The recovery operation is an operation in which energy generating elements provided upstream of the ink ejection outlet with respect to the direction of the ink flow in the recording head to produce energy for ejecting the ink, are driven to eject the ink from all of the ejection outlets, so that the causes for the improper ejection such as bubbles, dust, the ink having increased viscosity, or the like are removed (preliminary ejection), and in which the ink is forcibly discharged through the ejection outlets, additionally, to remove the improper ejection causes.

A pump 53 provides sucking force for the forced ink ejection. It is also used to suck the ink received by the cap 51 at the time of the ejection recovery operation by the forced ejection or at the time of the ejection recovery operation by the preliminary ejection. The residual ink sucked by the pump 53 is contained in a residual ink container 55 for containing the residual ink, through a tube 57 connecting the pump 53 and the residual ink container 55.

A wiping blade 59 wipes the ejection outlet side surface of the recording head, and is supported for movement between a wiping position in which it is projected to the recording head to wipe the recording head during movement thereof and a retracted position in which the blade 59 is out of contact with the ejection side surface. A cam 63 is connected with a motor (SM) 61 to drive the pump 53 and to move the cap 51 and the blade 59.

Figure 3:
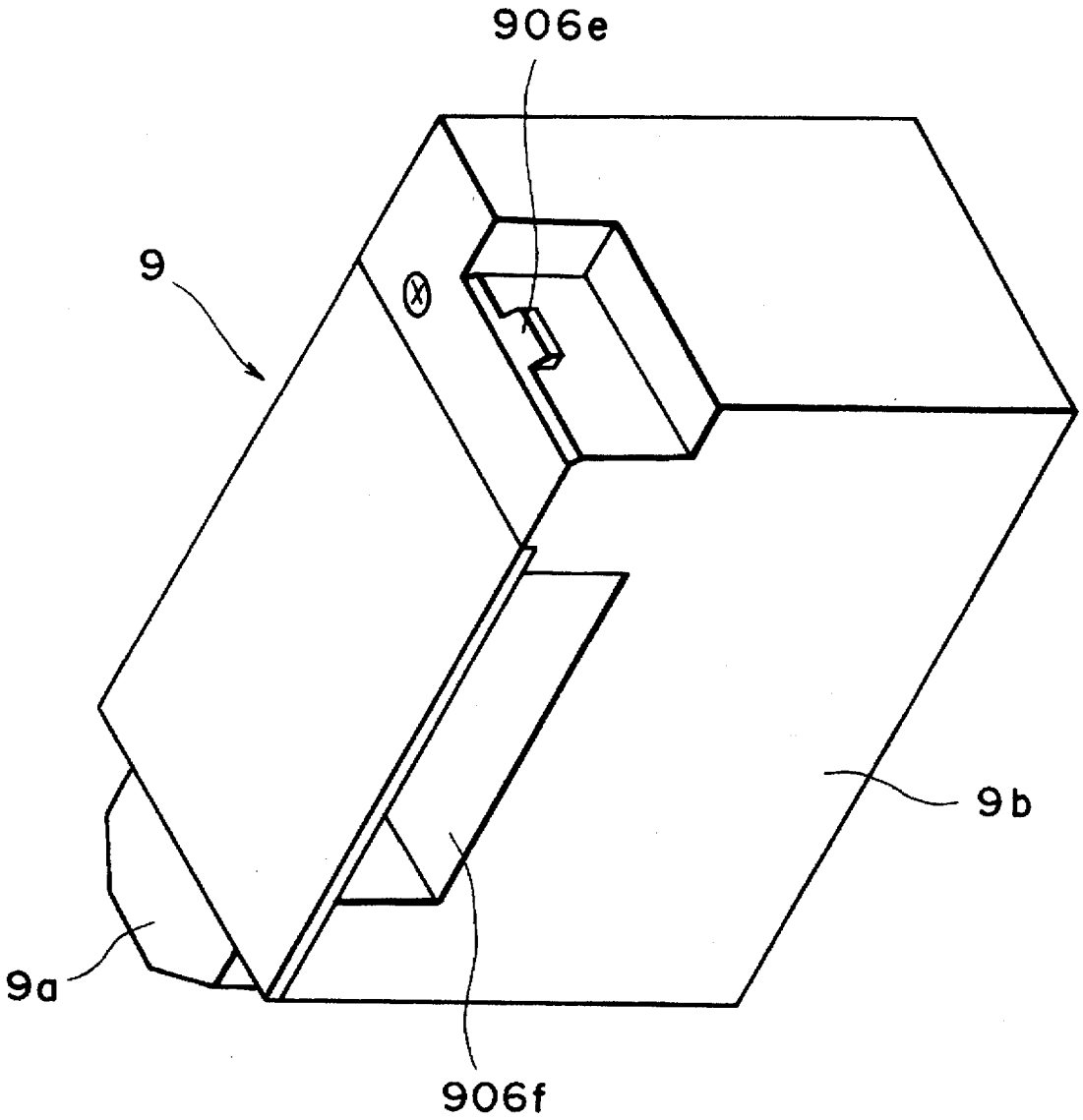
FIG. 3 shows an outer appearance, in a perspective view, a head cartridge of FIG. 2.

The description will be made as to the head cartridge 9. FIG. 3 shows an outer appearance in a perspective view of a head cartridge 9 having an integral ejection unit **9*a* and an ink container 9*b* which constitute the main assembly of the ink jet recording head. It comprises a pawl 906*e* engageable with the hook 13 of the carriage 11, when the head cartridge 9 is mounted on the carriage. As will be understood from FIG. 3, the pawl 906***e* is disposed inside the entire length of the recording head. Adjacent the ejection unit 9*a* of the head cartridge 9, there is a positioning abutment portion, although it is not shown. A head opening 906*f* is formed in the carriage 11 to receive a flexible base (electric connection) and a rubber pad.

Figure 4A:
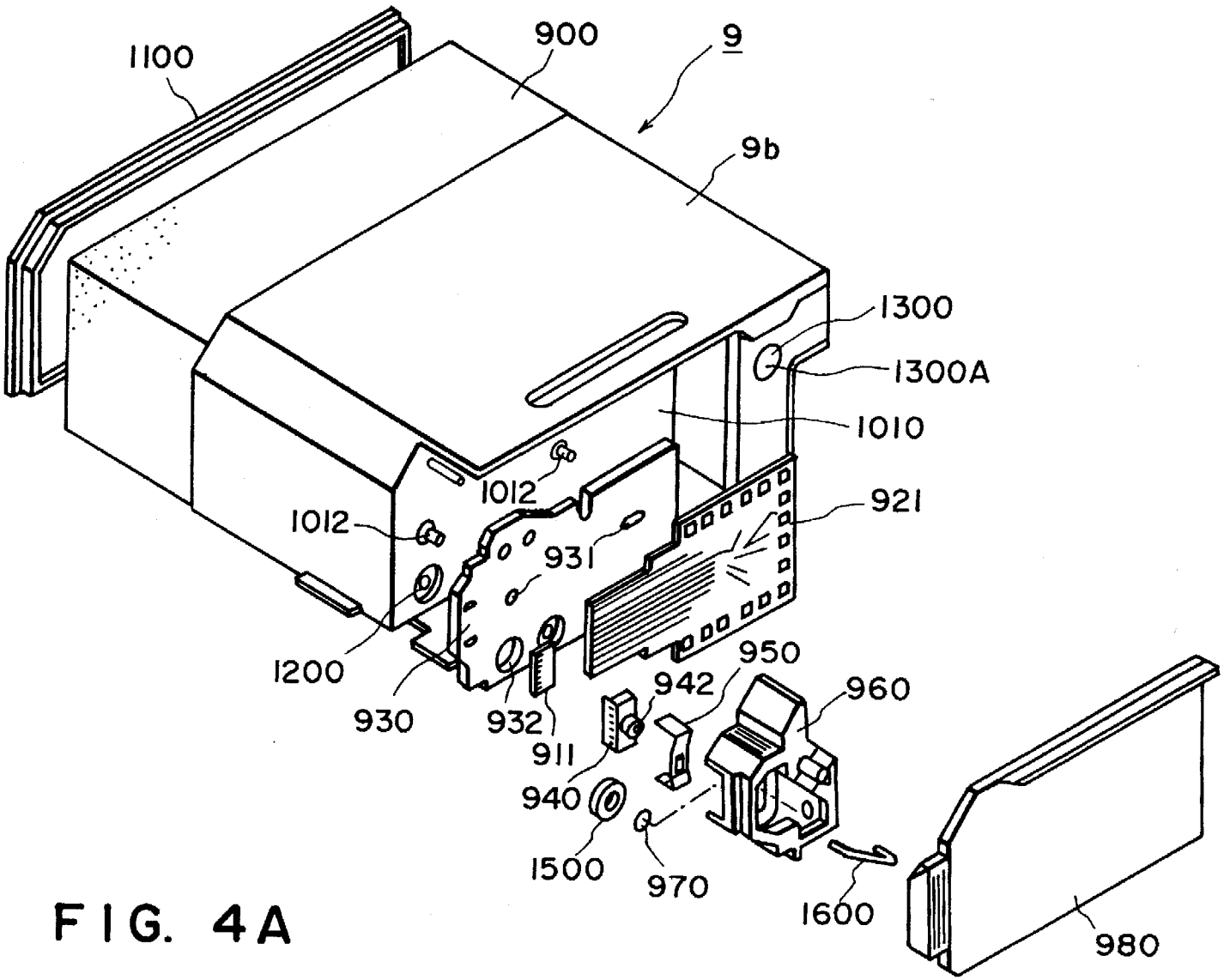
FIGS. 4A and 4B are an exploded perspective view and a perspective view of an outer appearance of a head cartridge shown in FIG. 3.
Figure 4B:
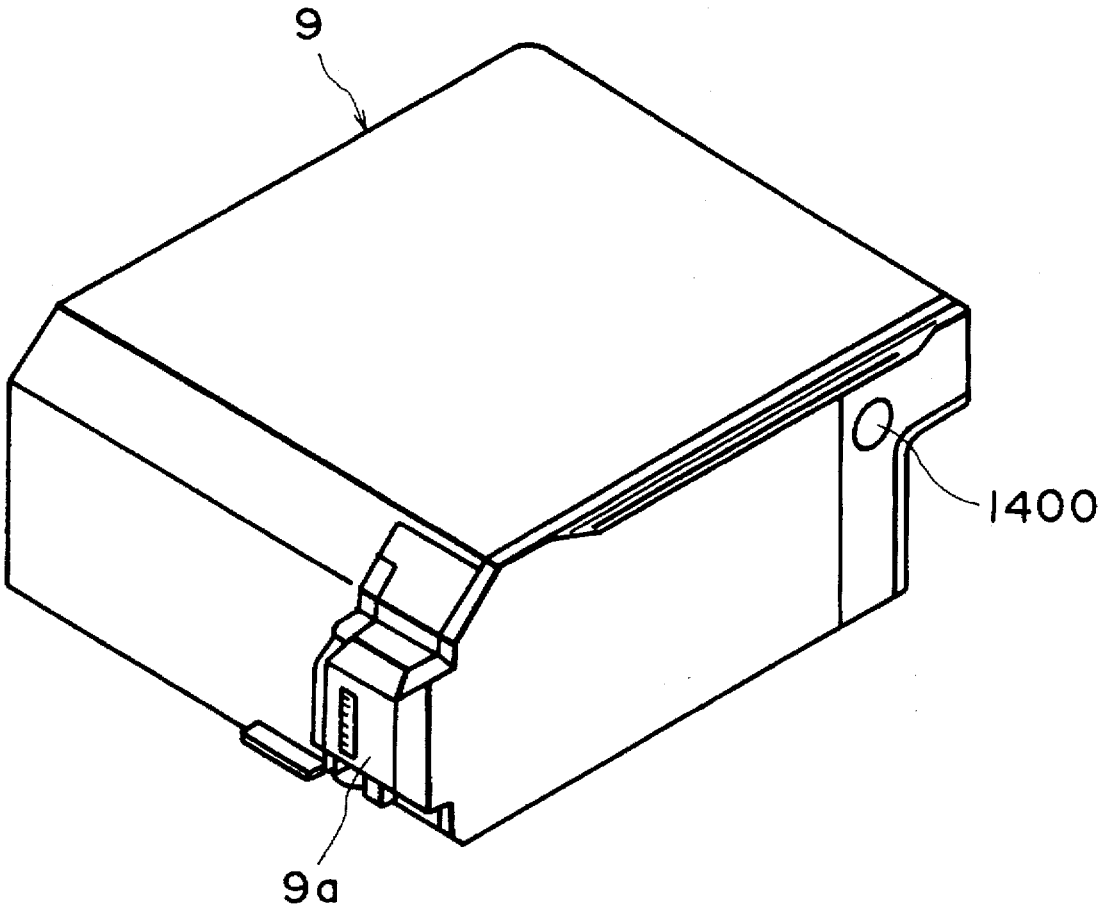

FIGS. 4A and 4B show an exploded perspective view of the head cartridge shown in FIG. 3. As described above, it is a disposable or replaceable type having an integral ink container (ink source).

Referring to FIG. 4A, a heater board 911 comprises Si substrate with a number of electrothermal transducer elements (ejection heaters) corresponding to the number of ejection outlets, a temperature keeping heater or heaters having an electrothermal transducer element or elements, and aluminum wiring for supplying electric power thereto. They are formed on the substrate through a film forming process. Corresponding to the heater board 911, there is provided a wiring board 921, and the corresponding wiring is properly connected by wire bonding or the like. A top plate 940 has partition walls for defining ink passages and a common liquid chamber. In this embodiment, the top plate 940 is also provided with an integral orifice plate.

The heater board 911 and the top plate 940 are clamped between a metal supporting member 930 and a clamping spring 950 so that the heater board 911 and the top plate 940 are securedly fixed by the spring force of the clamping spring 950. The supporting member 930 may function to support the wiring board 921 mounted thereto by bonding or the like, and also functions as an index for positioning the head relative to the carriage 11. The supporting member 930 may function to radiate the heat of the heater board 911 produced by the driving of the recording head.

The recording head comprises a supply ink container 960 which is supplied with the ink from the ink supply source in the form of an ink container 9*b*, and it functions as a subordinate container for supplying the ink to the common liquid chamber constituted by the heater board 911 and the top plate 940. A filter 970 is disposed in the supply container 960 adjacent an ink supply port to the common liquid chamber. The supply container 960 has a cover 980.

An ink absorbing material 900 for retaining the ink is packed in the ink container 9*b*. An ink supply port 1200 supplies ink to the ejection unit 9*a* constituted by the elements 911–980. Before the unit is mounted to the portion 1010 of the ink container main assembly 9*b*, the ink is injected through the supply port 1200, so that the absorbing material 900 absorbs the ink.

Designated by a reference numeral 1100 is a cover for the main assembly of the cartridge, which is provided with an air vent for communication between the inside of the cartridge and the ambience. The inside of the air vent 1400 is provided with a water repelling material 1300, so that the ink is prevented from leaking through the air vent 1400.

When the ink container 9*b* is filled with the ink through the supply port 1200, the ejection unit 9*a* constituted by the elements 911–980 is mounted to the portion 1010 at the correct position. The positioning and the securing is assured by engagement between the projections 1012 of the main assembly of the ink container and corresponding holes 931 in the supporting member 930. Thus, the head cartridge 9 as shown in FIG. 4B is provided.

The ink is supplied from the inside of the cartridge to the supply container 960 through the supply port 1200, the opening 932 in the supporting member 930 and an opening formed in the backside of the supply container 960 (FIG. 4A). Then, the ink is supplied to the common liquid chamber through proper supply pipe and ink inlets 942 of the top plate 940. The connecting portions along the ink passage are provided with gasket made of silicone rubber or butyl rubber or the like, so that the connecting portions are hermetically sealed to assure the flow of the ink.

Figures 5, 5B:
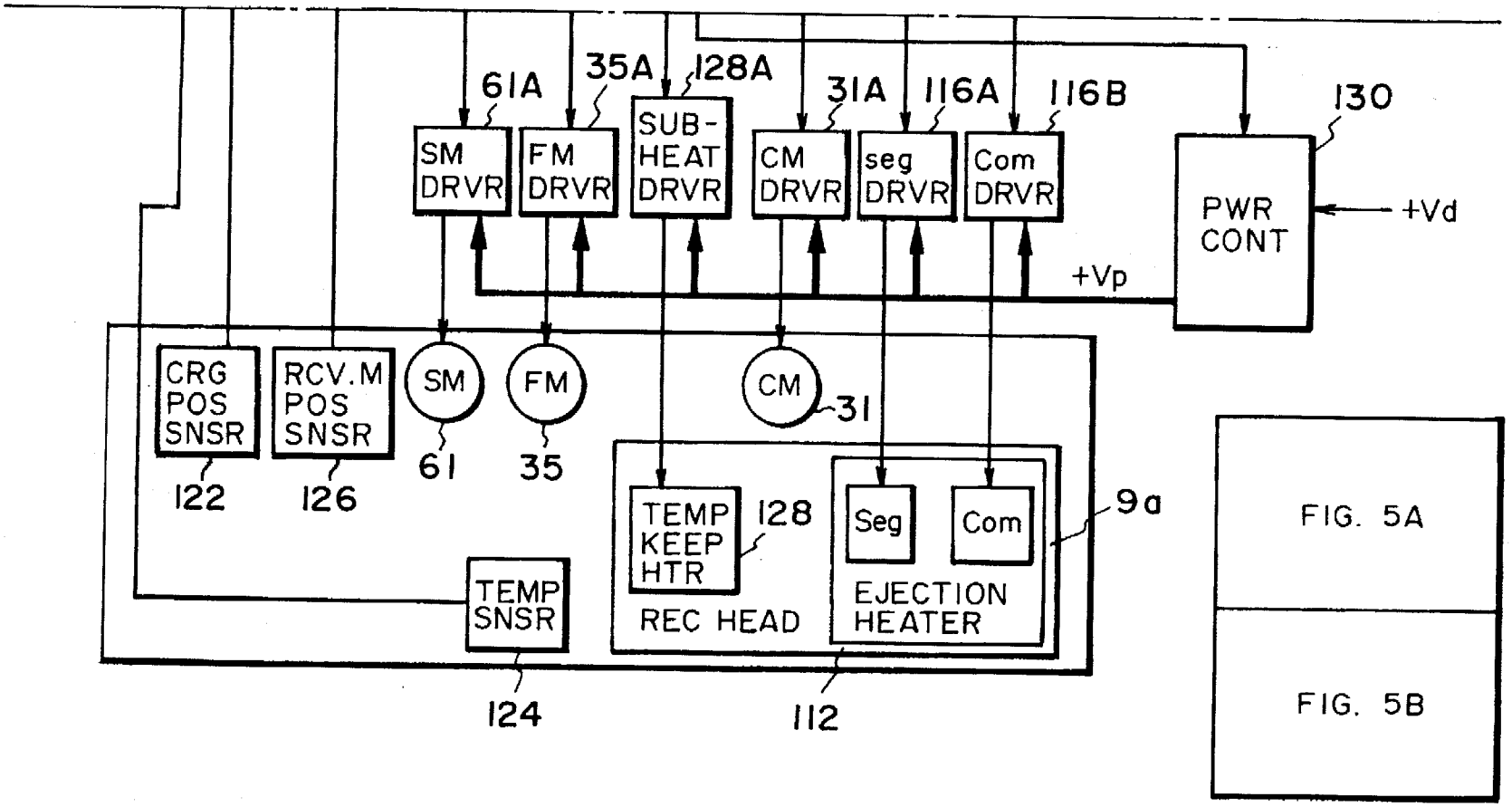
FIGS. 5A and 5B combined is a block diagram of a control system for the electronic typewriter shown in FIG. 1A and others.

FIG. 5 is a block diagram of a control system for the electronic typewriter according to this embodiment.

It comprises as the major part a CPU in the form of a microprocessor to execute proper process in accordance with data from the keyboard 1 and the control signals, a ROM 104 storing a program corresponding to the record control process executed by the CPU 100, a character generator (CG) and other fixed data, and a RAM having a work area usable as a register or the like, a line buffer for storing print data for one line, a key buffer for storing key input data, FDD buffer for storing the data read out of a floppy disk, and an operational area for the print counter for the printing time and the waiting counter for counting the waiting time, or the like. An interval control circuit 108 functions to accept the key inputs to the keyboard 1 at the predetermined interval by supplying to the CPU 100 key interval interruption signals 505 having the predetermined interval in accordance with the interruption signals 501 produced by a key timer 1A. Also, it produces interruption signals 404 in response to LCDC interruption signal 502 relating to display and drive for the display 6, a second timer interruption signal 503 from a second timer relating to the drive of the carriage motor 31 and the ejection heaters, and first timer interruption signal 504 from a first timer for controlling drive of the conveying motor 35 and the temperature keeping heater 128. A display controller 110 functions to display the data on the display 6 in the form of a liquid crystal display (LCD). A usual timer 506 is used to count the time period from the line recording immediately before, which will be described hereinafter, for example.

A head controller 114 incorporating the second timer produces control signals for a head driver 116 (segment drivers 116A, a common driver 116B) for actuating or driving the ejection energy generating elements of the ejection unit (recording head) 9*a* and the control signals for the carriage motor driver 31A. Designated by 61A, 35A and 128A are an SM driver, an FM driver and sub-heat driver for driving a recovery system motor 61, a conveying motor 35 and the temperature keeping heater 128, respectively.

A print dot buffer 120 processes the data received thereby for printing and stores the dot data for one line for the recording, and comprises a print buffer area PB. It may comprises an input buffer area IB to store the data in the dot buffer 120 when the head controller 114 is provided with an interface for receiving external data. A carriage position sensor 122 detects a predetermined position of the carriage 11; a motor position sensor 126 detects the rotational position of the recovery system motor 61; and a temperature sensor 124 detects the ambient temperature around the recording head 9*a*, in other words, the ambient temperature of the apparatus. A power source controller 130 responsive to instructions (recording mode) from the output port the voltage Vp to be supplied to the drivers 31A, 35A, 61A, 116A, 116B and 128A. By controlling the voltage Vp, the driving torque for the carriage motor 31 can be increased so as to increase the speed of the carriage movement. For example, it supplies 18V in the fine recording mode and supplies 24V in the draft recording mode. Designated by 132 is a floppy disk drive; and 132A is a floppy disk drive controller.

Figure 6:
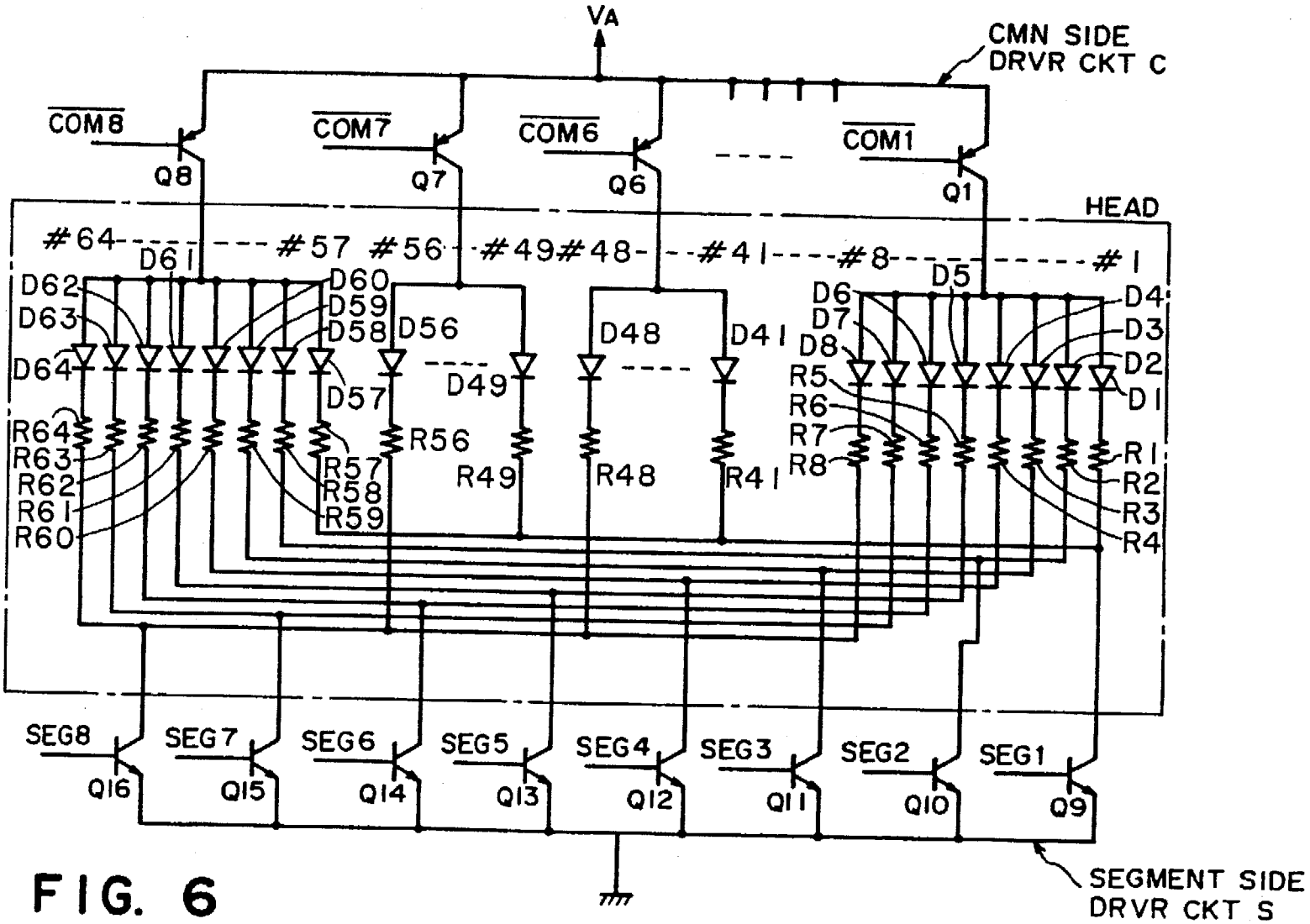
FIG. 6 is a circuit diagram of an example of a circuit of the recording head and the driver therefor, of a printer in a character processor.

FIG. 6 shows an example of electric structure of the recording head and the head driver 116. In this embodiment, the ejection unit 9*a* is provided with 64 ejection outlets, and #1–#64 in FIG. 6 corresponds to the number positions of the ejection outlets in the ejection unit 9*a*. Designated by R1–R64 are electrothermal transducer elements in the form of heat generating resistors for the respective ejection outlets #1–#64. The heat generating resistors R1–R64 are grouped into 8 blocks each containing 8 ejection outlets, and the resistors in a certain block are commonly connected with an associated switching transistor Q1–Q8 in a common driver circuit C. The transistors Q1–Q8 are responsive to on/off of the control signals $\overline{\text{COM1}}$–$\overline{\text{COM8}}$ to connect or disconnect the power supply paths. In the paths for the heat generating resistors R1–R64, diodes D1–D64 for preventing opposite direction flow of the current.

The counterpart heat generating resistors in the respective blocks are connected with an on/off transistor Q9–Q16 in a segment driver circuit S. The transistors Q9–Q16 are responsive to on/off of the control signals SEG1–SEG8 to connect or disconnect the power supply paths to the associated heat generating resistors.

Figure 7:
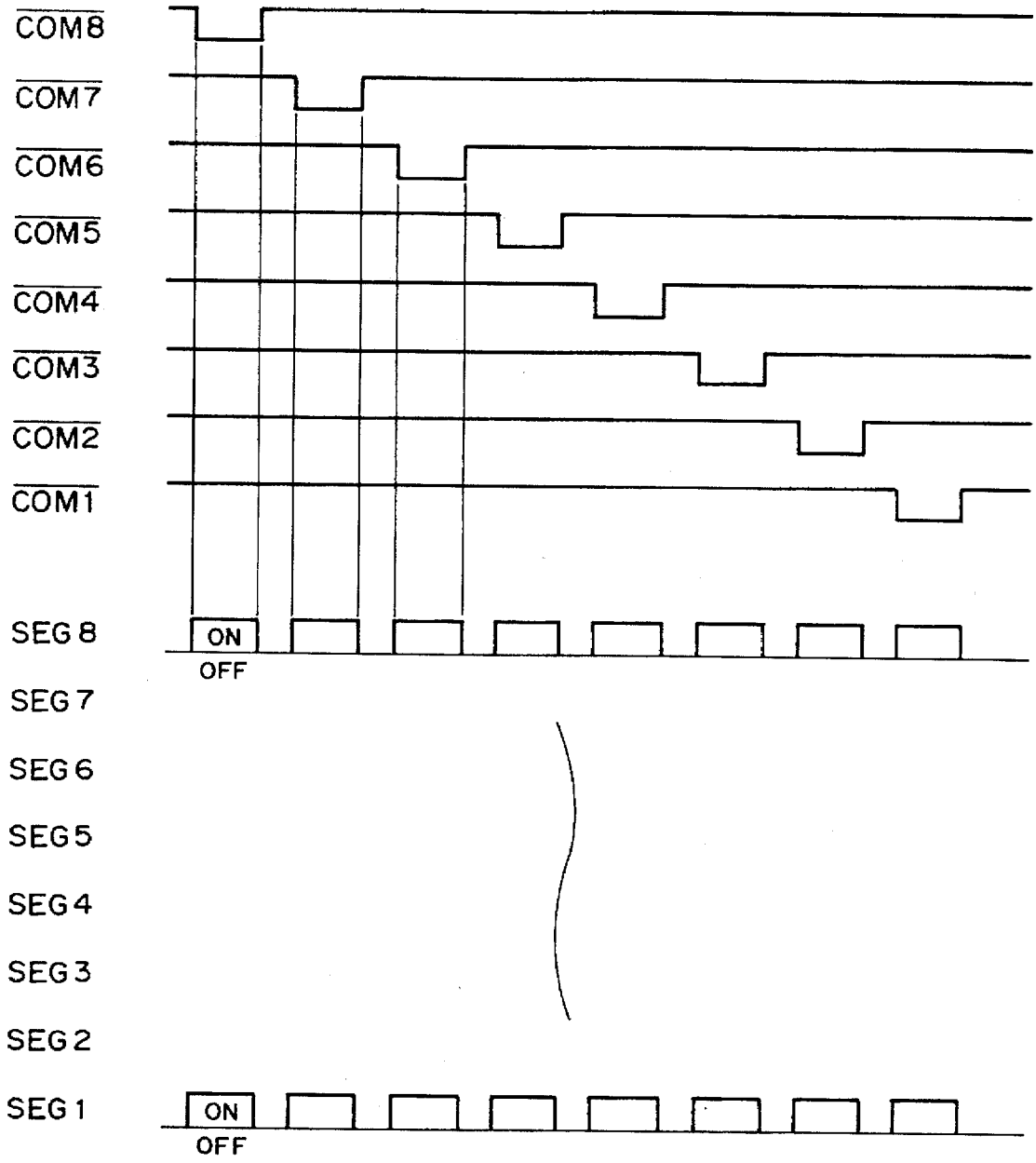
FIG. 7 is a timing chart of the head drive.

FIG. 7 is a timing chart of the head drive. At a certain position along the head scan, the common control signals $\overline{\text{COM8}}$–$\overline{\text{COM1}}$ are sequentially actuated. By the actuation one block is selected to enable power supply. In the selected block, the segment control signals SEG8–SEG1 are selectively rendered on or off in accordance with the image to be recorded, by which the heat generating resistors are selectively supplied with the electric power, upon which the ink is selectively ejected in response to the heat generation, so that the dot recording is effected.

Figure 8:
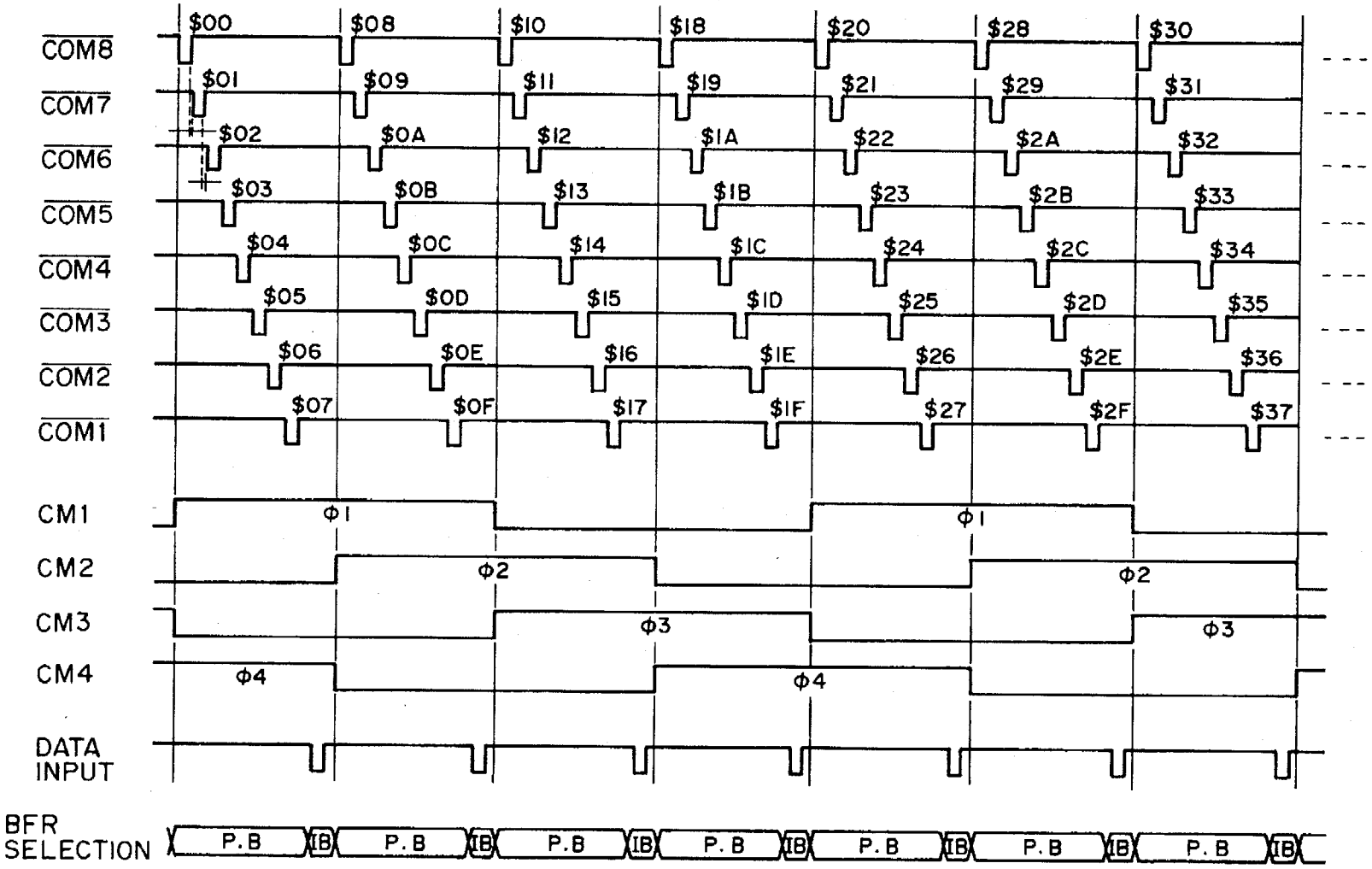
FIG. 8 is a timing chart of an example of the operational timing of various portions of the head controller in this embodiment.

FIG. 8 is a timing chart illustrating the output timing of the signals $\overline{\text{COM8}}$–$\overline{\text{COM1}}$ during the recording by the head controller (carriage motor and ejection heater control circuit) 114 and output timing of the motor drive signals CM1–CM4. The figure also shows the data receiving timing and selection timing for the areas PB and IB of the dot buffer 120 in the case where the head controller 114 is provided with an interface for receiving external data. In the Figure, one dot in the scanning direction corresponds to one step of the motor.

As shown in the Figure, during the recording at a position in the scanning direction, the buffer area PB is selected, and the addresses (for example $00–$07) storing the data to be printed on that position are sequentially designated, so that the data are selected and outputted, by which the signals $\overline{\text{COM8}}$–$\overline{\text{COM1}}$ are sequentially outputted, and the signals SEG8–SEG1 are produced corresponding to the data at the timing for the respective outputs, as shown in FIG. 7. Thus, the recording operation is carried out. Upon the completion of the recording action at this position, the buffer area IB is selected, and the received data are stored.

Figure 9:
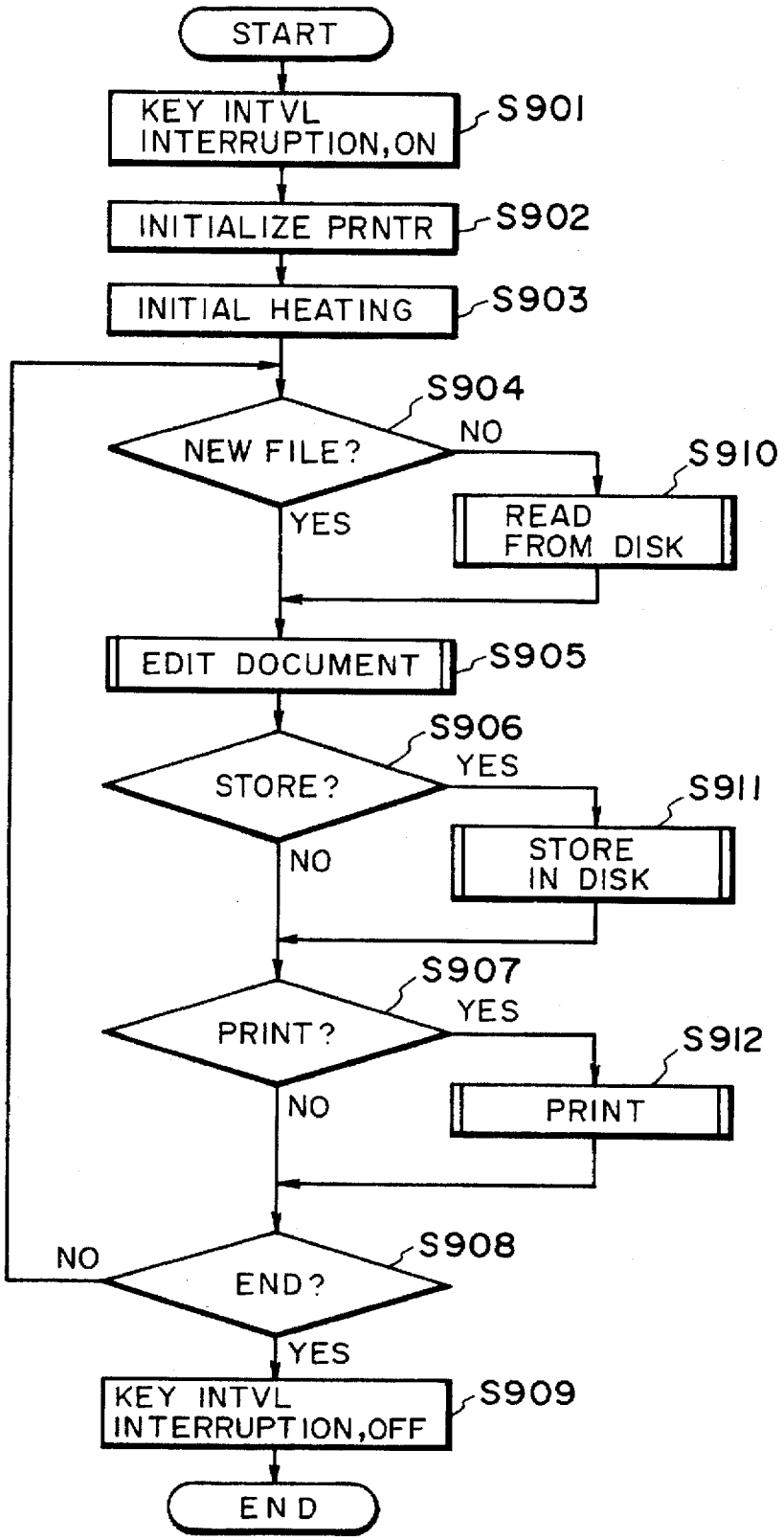
FIG. 9 is a flow chart of operations of the electronic typewriter.
Figures 1, 10A:
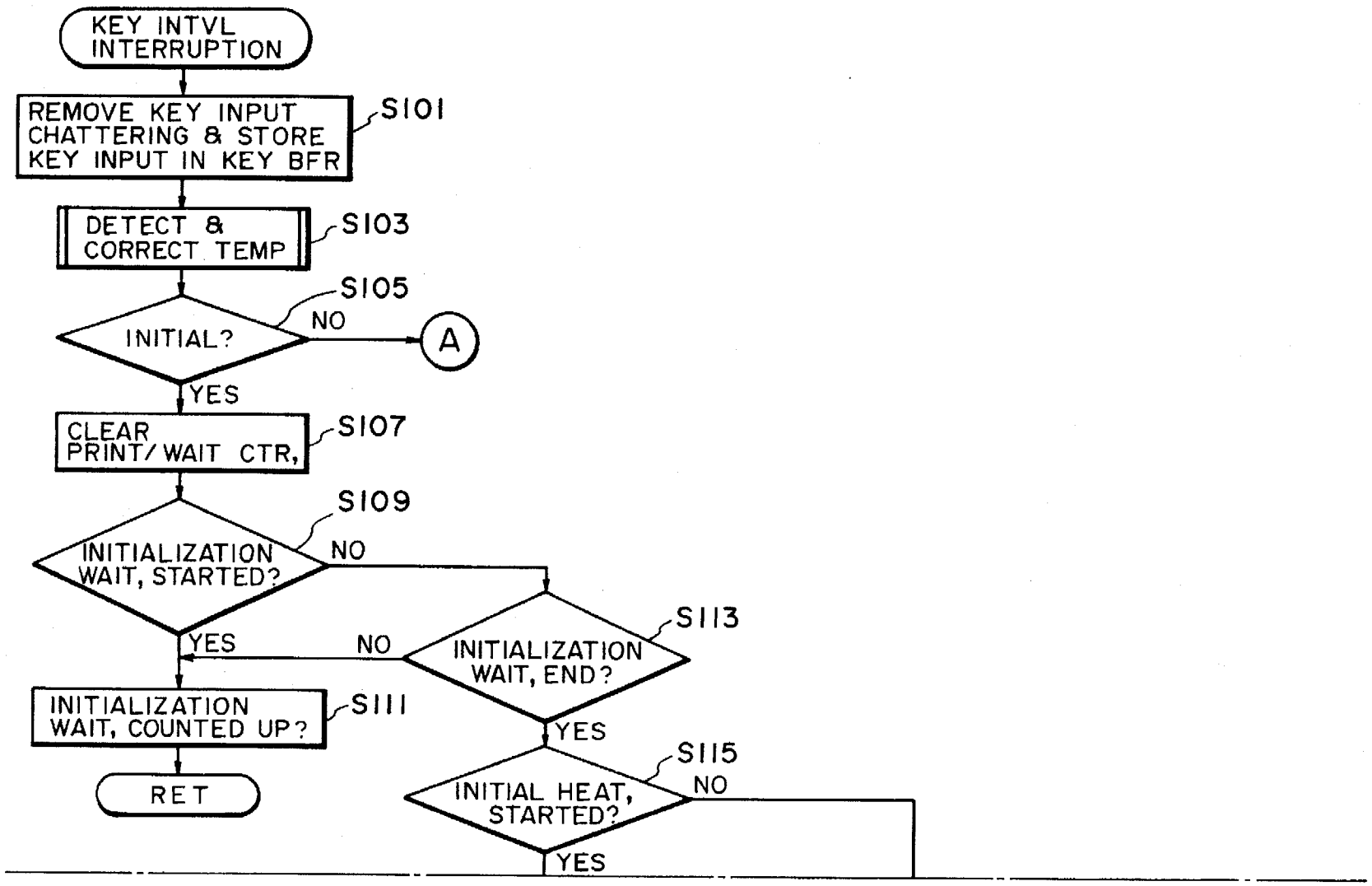
FIGS. 10A, 10B, 10C and 10D are flow charts of a sub-heat control process by key interval interruption.
Figures 2, 10A:
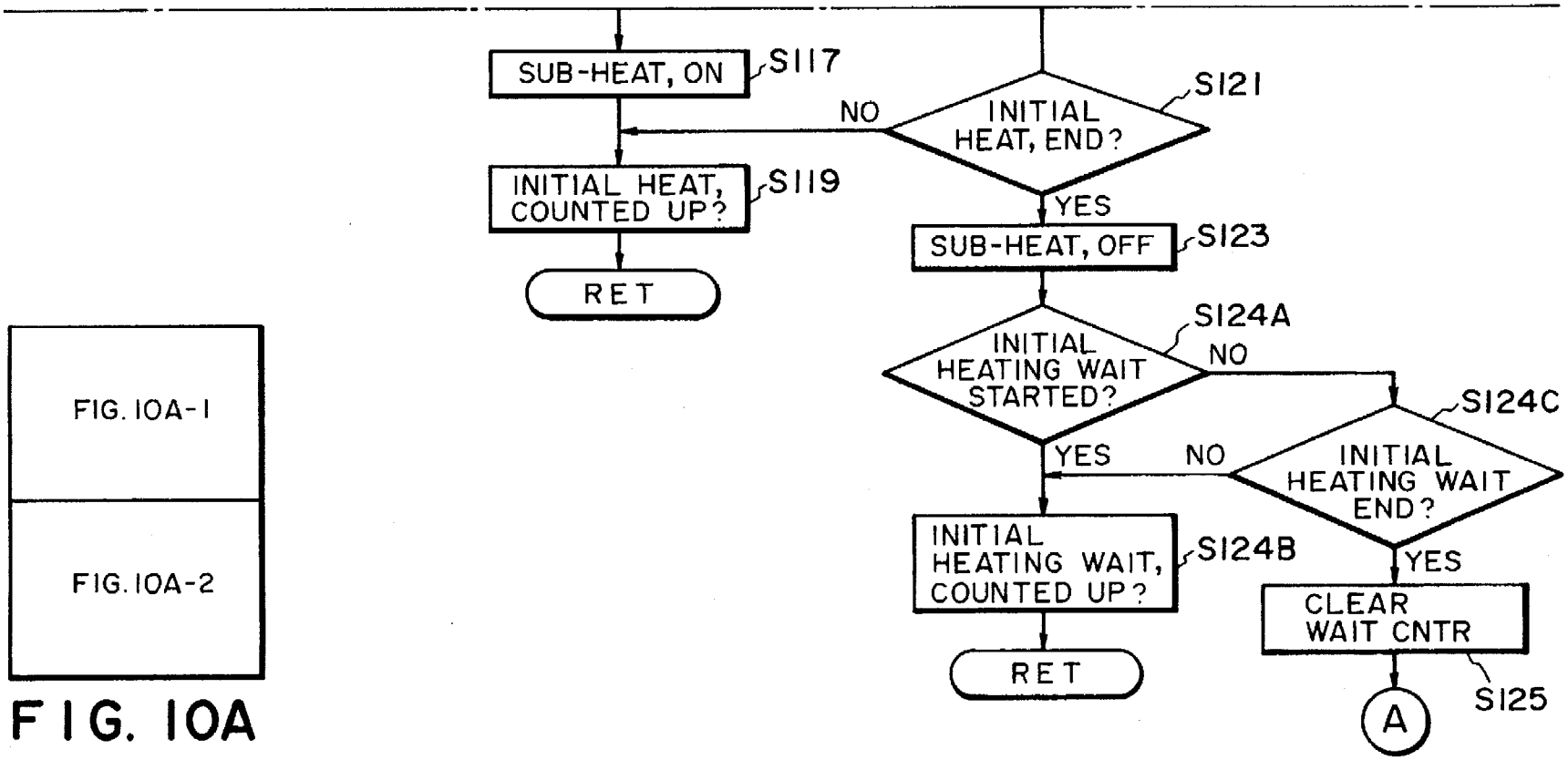
Figures 1, 10B:
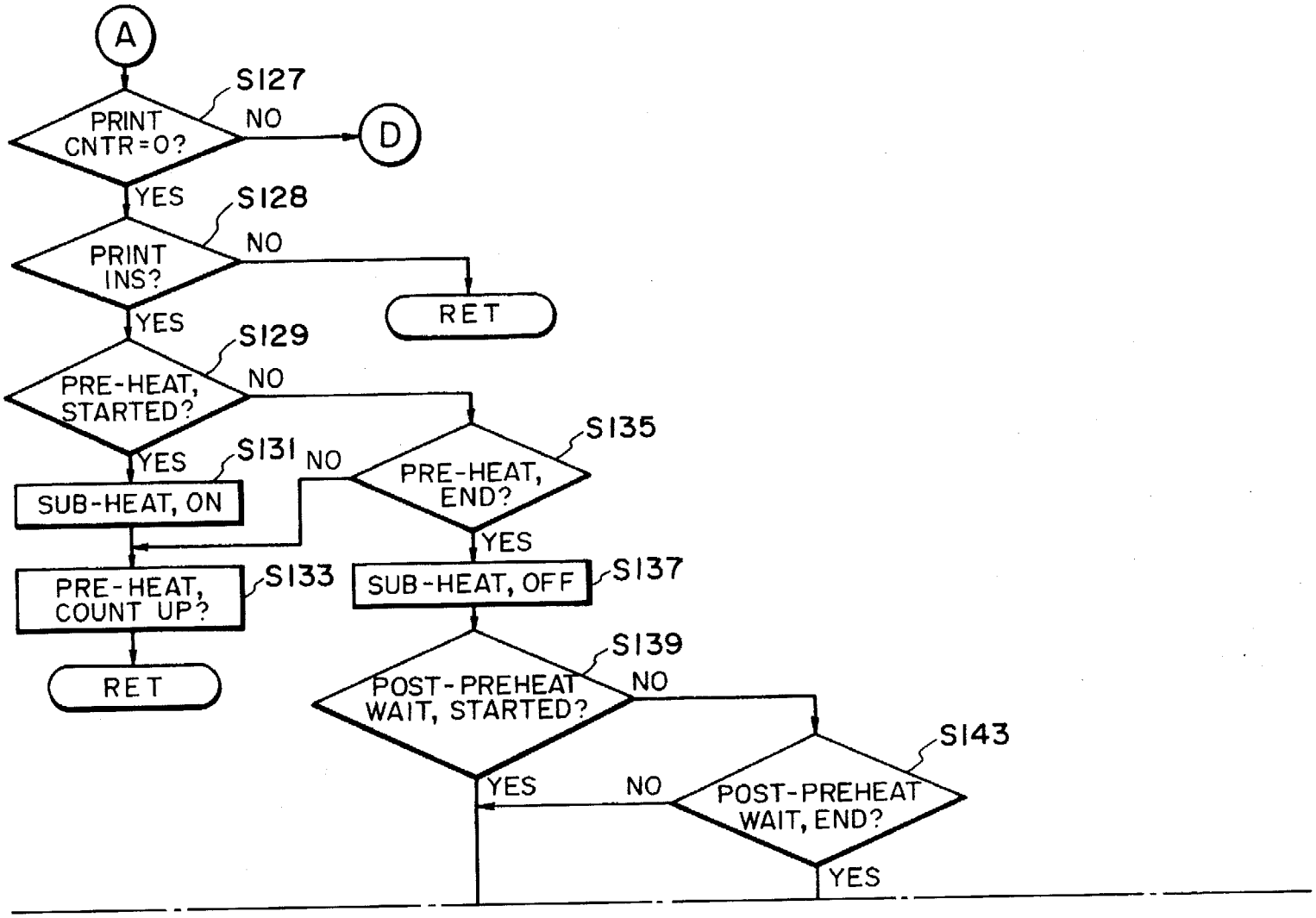
Figures 2, 10B:
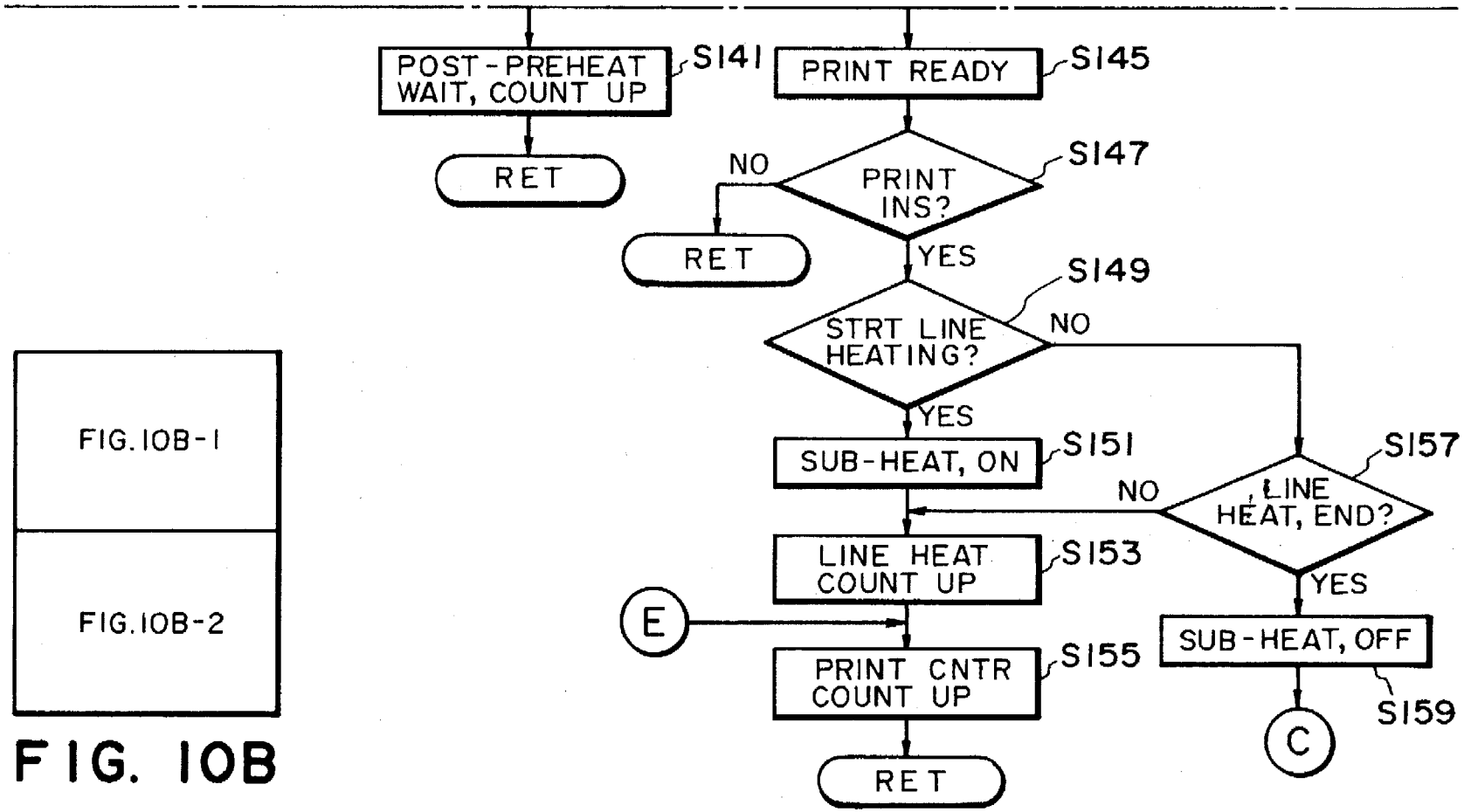
Figures 1, 10C:
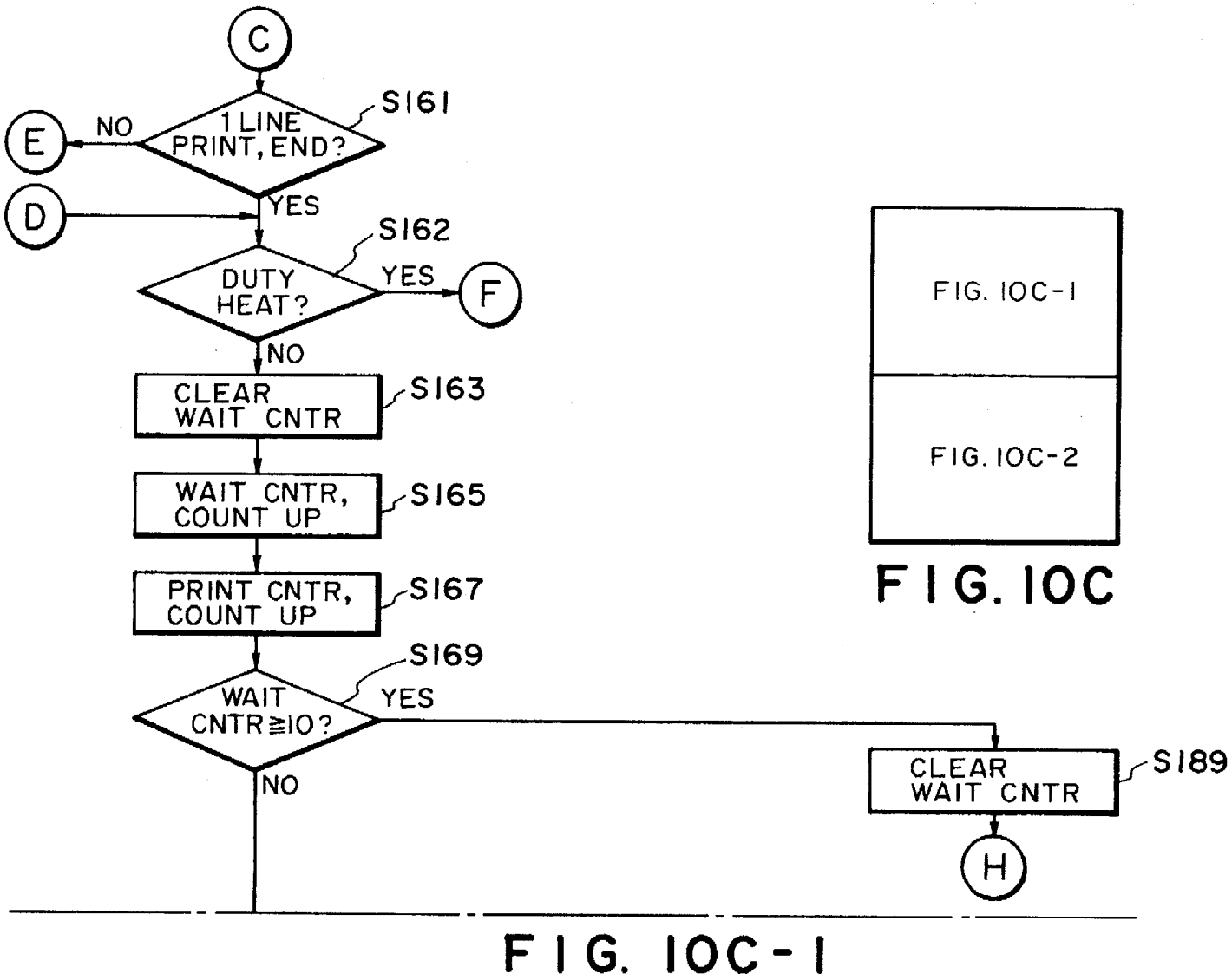
Figures 2, 10C:
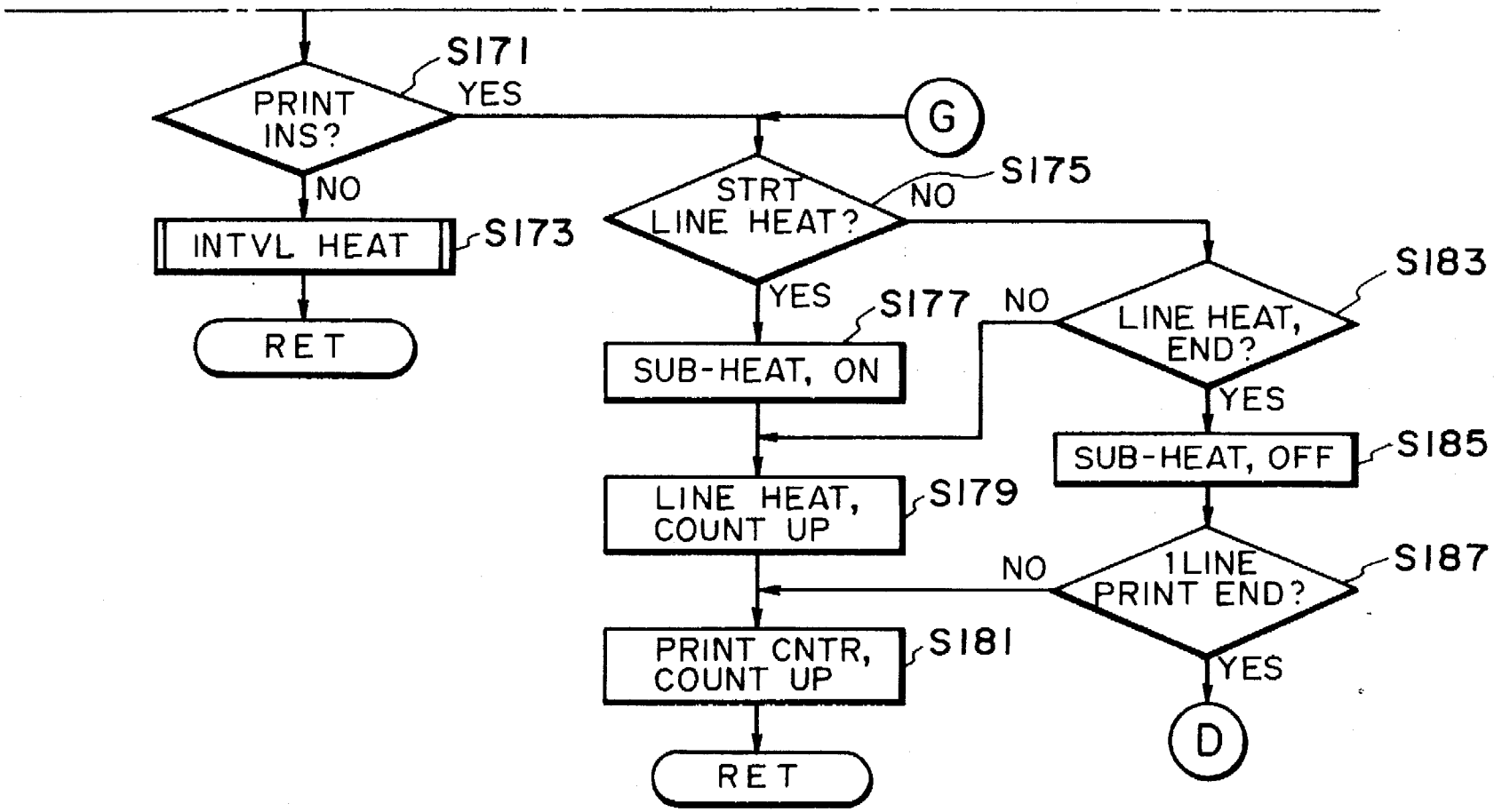
Figure 10D:
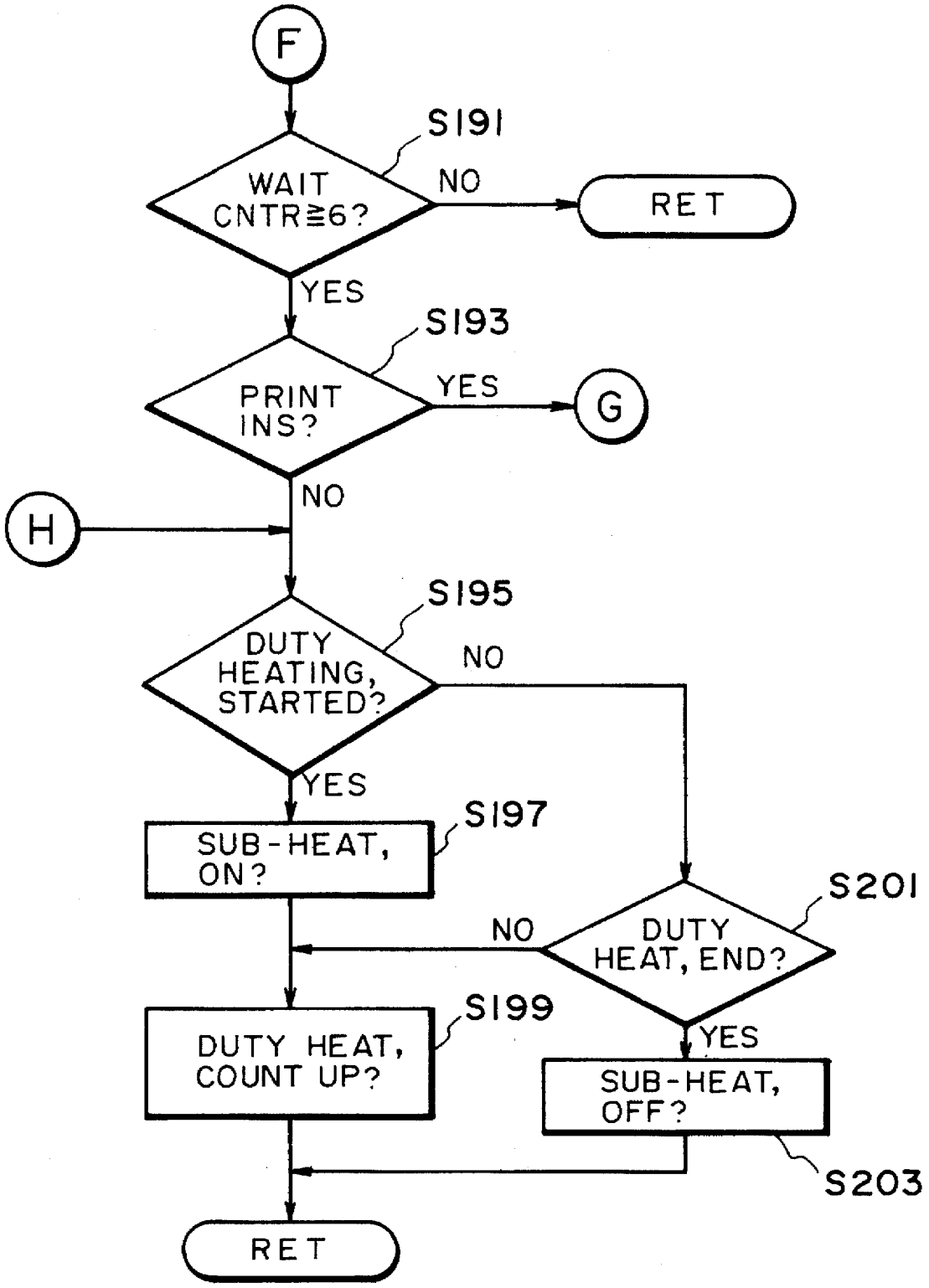

FIG. 9 is a flow chart illustrating sequential operations for editing and printing in the electronic typewriter in this embodiment. When the main switch of the electronic typewriter is actuated, the sequential operation starts. At step S901, the key interval interruption on the basis of the key timer becomes receptable. Then, at step S902, the initial operation for the printer such as ejection recovery operation for the recording head or the like is performed. At step S903, an initial heating operation which is one of the sub-heat operations, is executed.

Figure 15:
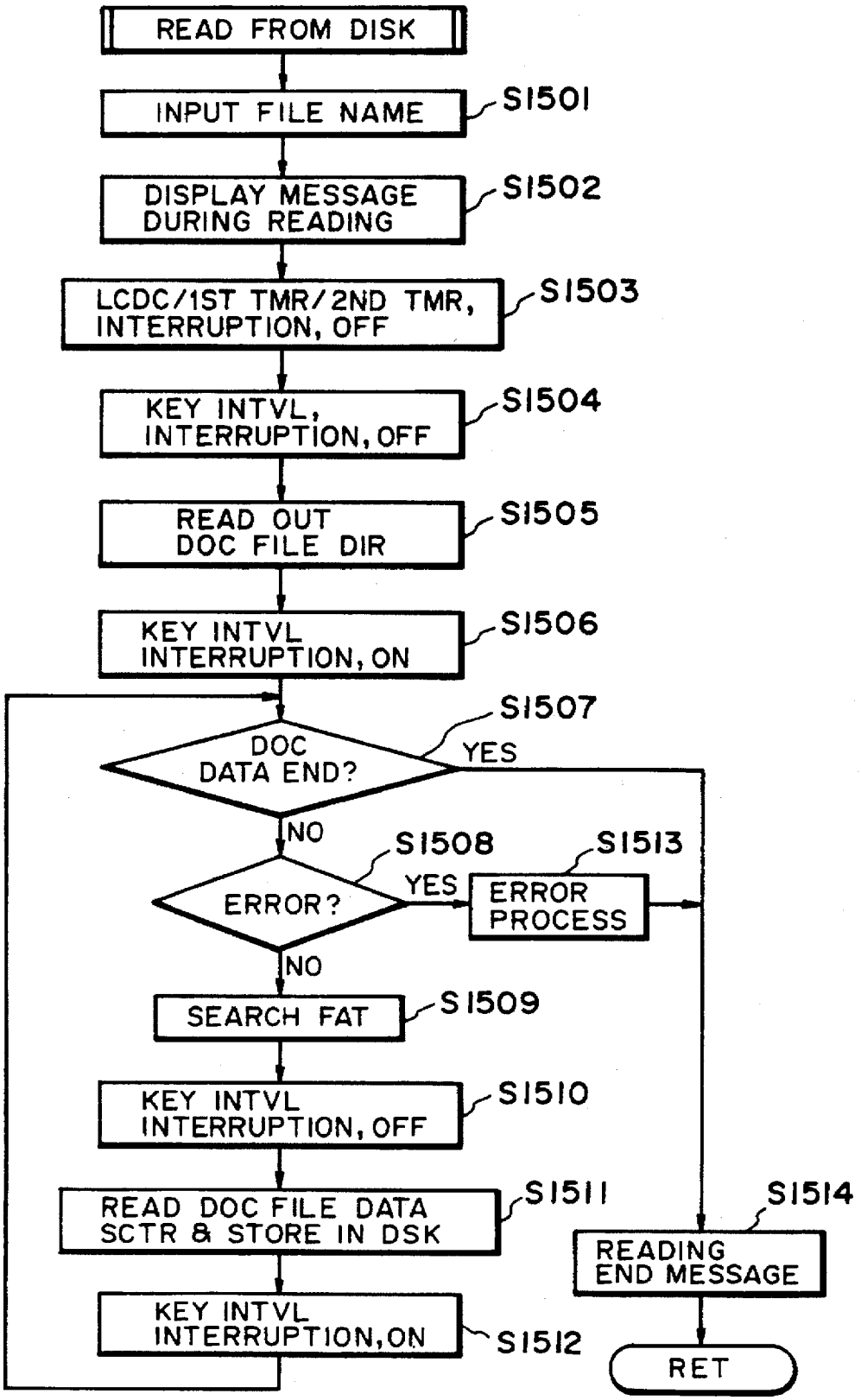
FIG. 15 is a flow chart illustrating the operations for the reading from a disk shown in FIG. 9.

At step S904, S905 or S910, the processing is carried out corresponding to the editing by the operator using the keys. More particularly, the discrimination is first made at step S904 as to whether or not a new file is intended or not. With the electronic typewriter of this embodiment, the printing operation is possible without editing the information supplied by the keys. In addition, it is possible to print a new file without storing the data thereof in a disk. Such processing is included in the editing and the printing. If the discrimination at the step S904 is affirmative, that is, the new file is intended, the operation proceeds to step S905. If the discrimination at the step S904 is negative, a reading operation which will be described hereinafter in conjunction with FIG. 15 is carried out, and the editing is carried out at step S905.

At step S906, the discrimination is made as to whether or not the finished document file is to be stored in the disk. If so, the file is stored at step S911, and then the operation proceeds to step S907.

At step S907, the discrimination is made as to whether or not the printing operation is executed. If so, the printing operation is effected at step S912, including ink ejection from the recording head 9*a* to the recording sheet in accordance with movement of the carriage 11 and recording sheet conveyance for each of printing lines. At step S908, the discrimination is made as to whether or not the process is to end. If not, the operation returns to the step S904. If so, the key interval interruption is accepted at step S909 to enable the acceptance, and the sequential operation ends.

As described in the foregoing, when the CPU 100 controls the editing or printing operations or the like, the key interval interruption on the basis of the key timer 1A is acceptable, and therefore, various key input information during the above is accepted by the key interval interruption. In addition, in this embodiment, utilizing the interruption timing, the timing for the printing period measurement and the waiting period measurement is generated, and various sub-heat control operations are carried out on the basis of the time measured.

The sub-heat controls in this embodiment are directed to (1) the initial heating for quickly increasing the temperature of the recording head upon actuation of the main switch, (2) the pre-heating for quickly increasing the head temperature immediately before the first printing after the actuation of the main switch, (3) the line heating carried out for the printings for respective printing lines, (4) the interval heating carried out in the short rest period between adjacent printing lines to maintain the constant head temperature, and (5) the duty heating for keeping the constant head temperature during the print waiting period. In the sub-heat control operation, a table indicative of the sub-heat period is used to maintain the recording head temperature at a target temperature during the printing period and the print waiting period except for the period immediately after the actuation of the main switch.

FIGS. 13A–13E show examples of the tables. FIG. 13A shows a table for the initial heating; FIG. 13B shows a table for the pre-heating; FIG. 13C shows a table for the line heating in the draft recording mode; FIG. 13D shows a table for the line heating in the fine recording mode; and FIG. 13E shows a table for the duty heating. As for the interval heating, the reference is made to the table for the line heating, and the sub-heat period is selected, and then, the heating operations are carried out at 1 sec intervals.

As will be understood from these Figures, two parameters are used for determining the sub-heat period (the power supply period to the temperature keeping heater 128) in each of the tables. The two parameters are print waiting period or printing period and a rank determined on the basis of the ambient temperature (actually an average of plural detections) by the temperature sensor 124.

The ranks are determined in the following manner. The reference is made to the table of FIG. 14 which has been made taking into account the hysteresis of the temperature detection, and for the rising temperature, rank 0 corresponds to the temperature not more than 14° C; rank 1, 14°–16° C.; rank 2, 16°–18° C.; rank 3, 18°–21° C.; and rank 4, not less than 21° C. Also in consideration of the hysteresis, for the decreasing temperature, rank 0 corresponds to not more than 13° C.; rank 1, 13°–15° C.; rank 2, 15°–17° C.; rank 3, 17°–20° C.; and rank 4, not less than 20° C. The line heating is carried out during acceleration of the carriage, and the common electric power source is used for the drive of the carriage and for the heater 128. For these reasons, the line heating operations are different between the normal fine mode operation and in the draft mode operation in which the carriage speed is doubled. To accomplish this, the respective tables (13*c* and 13*d*) are provided. This also applies to the interval heating. As described above, the different tables for the heating period are used in accordance with the carriage speeds (driving source), and therefore, the supply of the thermal energy per unit time can be maintained constant.

Figure 11:
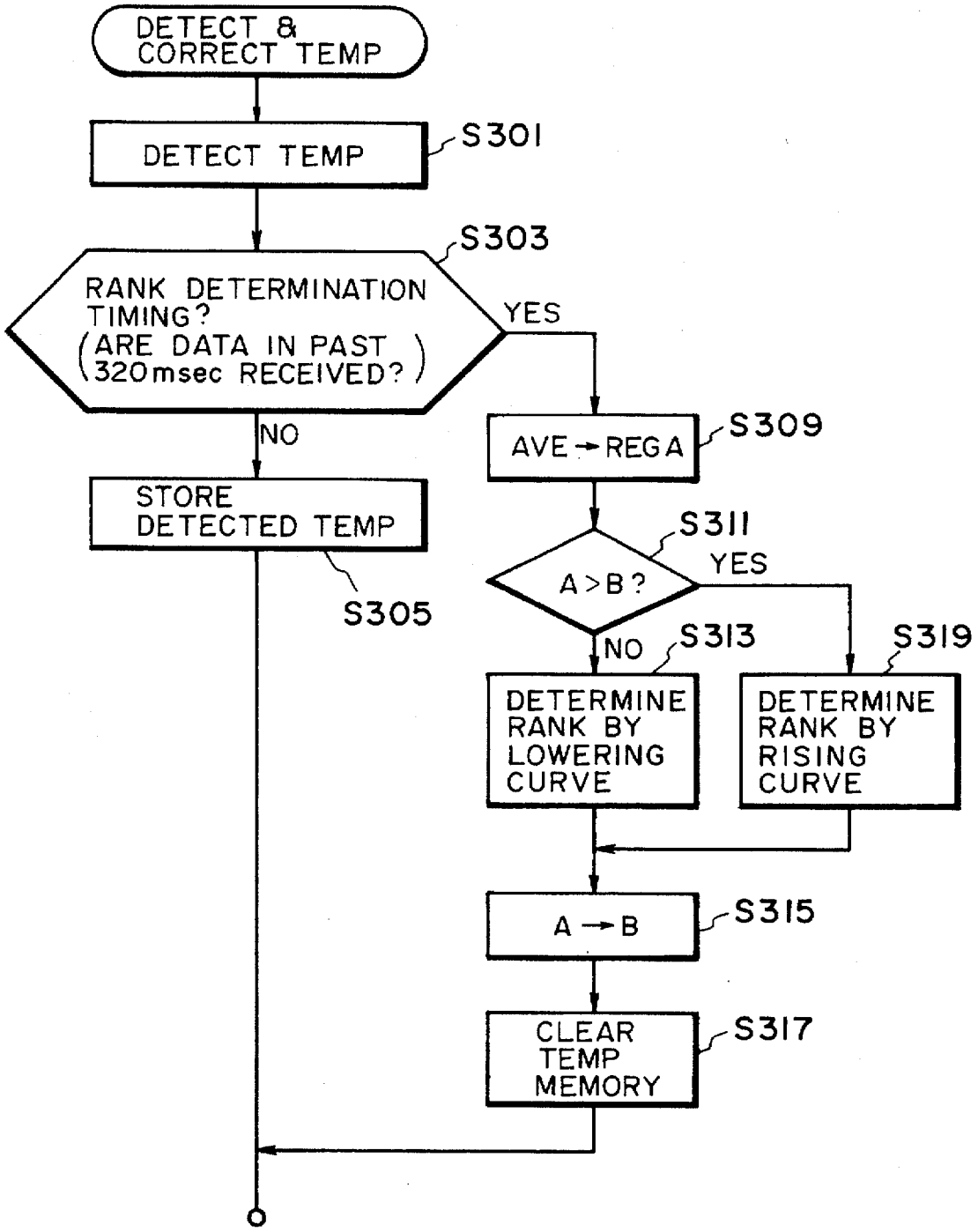
FIG. 11 is a flow chart showing the detail of a temperature detecting operation and a temperature correcting operation shown in FIGS. 10A–10D.
Figure 12:
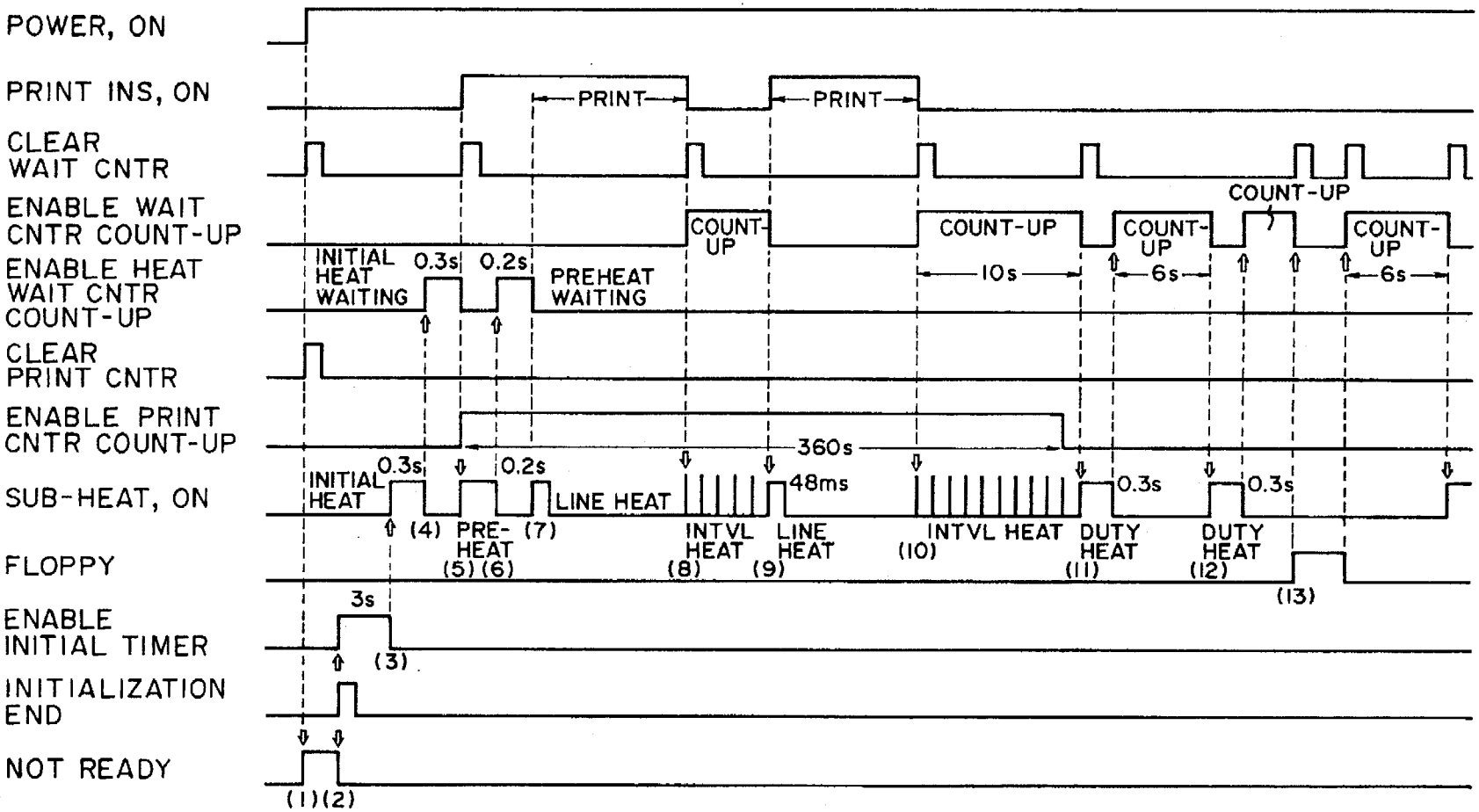
FIG. 12 is a sub-heat control timing chart by the key interval interruption process.

FIGS. 10A–10D and 11 show flow charts for the operations executed upon key interval interruption on the basis of the key timer 1*a* in this embodiment. FIG. 12 shows a timing chart relating to this operation.

The description will be made as to the key interval interruption operation, referring to these Figures. The key interval interruption occurs every 8 msec, upon which the key interval interruption operation is started. Upon the start, at step S101, the key input by the operator is accepted. More particularly, the chattering removing operation for the key input and the storing of the input data in the key buffer to the RAM 106 are carried out. At step S103, the temperature detection and temperature correcting process described in detail in conjunction with FIG. 11, are carried out. At step S105, the discrimination is made as to whether the apparatus is at the initial stage occurring immediately after the actuation of the main switch. If so, the print counter (printing period counter) in the RAM 106 and the print wait counter (print waiting period counter) are cleared at step S107 (a point of time (1) in FIG. 12). At step S109 the discrimination is made as to whether or not the initializing operation for initializing the apparatus is to be carried out. If so, the waiting period for the initialization is counted at step S111 (2). If not, the discrimination is further made at step S113 as to whether or not the waiting counter for the initialization is counted up or not. If not counted up, the count-up is awaited.

When it is discriminated that the waiting period for the initialization (for various parts of the apparatus, such as RAM 106 or the like) ends, at step S113, the discrimination is made as to whether or not the timing for the start of the initial heating operation comes. If so, the sub-heat is actuated at step S117 (3), and thereafter, the initial heating period is counted at step S119 so as to effect the initial heating operation in accordance with the table shown in FIG. 13A. In other words, the temperature keeping heater 128 is energized for the sub-heat period corresponding to the rank determined at step S103. In FIG. 12, the initial heating period of 0.3 sec corresponds to rank 0, but it is only an example. This applies to the sub-heating period shown in FIG. 12. If the discrimination at step S115 is negative, the discrimination is made at S121 whether or not the initial heating ends. If not, the count-up of the initial heating period is awaited at step S119.

As will be understood from the foregoing, according to this embodiment, the start timing for the initial heating which is one of the sub-heat controls is controlled by the operation of the key interval interruption. The same applies to the start timing for the pre-heating, the line heating, the interval heating and the duty heating, and the start timing for another operations.

When the end of the initial heating is discriminated at step S121, the sub-heating operation is stopped at step S123. At steps 124A, the discrimination is made as to whether or not the waiting period after the initial heating is to start. If so (4), the waiting period for the initial heating is started. The waiting period is provided for the purpose of dissipating the heat produced by the initial heating, and it is as long as 0.3 sec in this embodiment. If the discrimination at step S124A turned out negative, the further discrimination is made at step S124C as to whether or not the waiting period after the initial heating operation ends. If not, the count-up of the waiting period is awaited at step S124B.

When the end of the waiting period after the initial heating operation is discriminated at step S124C, the waiting counter is cleared at step S125, and the print counter is enabled to permit counting the printing period (5). When the print counter counts 360 sec, it retains the count thereafter, in other words, the print count-up enabling signal is rendered off. Then, at step S127, the discrimination is made as to whether or not the print counter of RAM 106 is 0.

If not, that is, if no line is printed, the further discrimination is made at step S128 as to whether or not the printing instructions are on state. If not, the operation returns to this process, and if so, the further discrimination is made at step S129 as to whether or not the timing for the start of the preheating comes. The printing instructions discriminated at step S128 include the instructions for driving the recording head 9 and the instructions for driving the various motors 31, 35 and 61. If it is already the timing for the start of the pre-heating operation, the sub-heating operation is actuated at step S131 to start the preheating operation (5), and the preheating period is counted at step S133. If it is not yet the timing for the start of the preheating operation as a result of the discrimination at step S129, the discrimination is further made at step S135 as to whether or not the preheating operation ends. If not, the count-up of the preheating period is awaited at step S133, and the operation returns to the main operation. The preheating period in this embodiment is 0.2 sec.

When the end of the preheating operation is discriminated at step S135, the sub-heating operation is stopped at step S137, and thereafter, the discrimination is made as to whether or not it is the timing for the start of the waiting period after the preheating operation. If so (6), the waiting period after the preheating operation is counted at step S141, and the operation returns to the main process. If the result of discrimination at step S139 is negative, the discrimination is made at step S143 as to whether or not the waiting period after the preheating operation ends. If not, the count-up of the waiting period after the preheating operation is awaited at step S141, and thereafter, the operation returns to the main process. The waiting period is also provided to dissipate the heat produced by the preheating operation.

When the waiting after the preheating operation is discriminated at step S143, the print ready is enabled at step S145, and the printing operation for one line is started in the recording apparatus. At the point of time of the end of the waiting period after the initial heating operation, the printing instructions are enabled, but the actual printing operation starts after the end of the waiting period after the preheating operation and upon the enabling of the print ready (point of time (7)). At step S147, the discrimination is made as to whether or not the printing instructions are produced. If not, the operation returns to the main process. If so, the discrimination is made at step S149 as to whether or not the interruption is at the timing for the start of the line heating operation. The printing instructions discriminated at step S147 are for driving the recording head 9*a*, and therefore, do not include the instructions only for various motors 31, 35 and 61.

If the outcome of the discrimination at the step S149 is affirmative, the sub-heating operation is started at step S151. At step S153, the line heating period is counted. When the printing period is counted up at step S155, the operation returns to the main process. If the outcome of the discrimination at step S149 is negative, the discrimination is made at step S157 on the basis of the count of the line heating operation as to whether or not the line heating operation ends. If not, the operations in the steps S153 and S155 are similarly executed, and therefore, the operation returns to the main process.

If the discrimination at step S157 indicates that the line heating operation has ended, the sub-heating operation is stopped at step S159. Then, the discrimination is made as to whether or not the printing operation ends, at step S161. If not, the operation returns to step S155. After the printing period is counted up, the operation returns to the main process. If the printing operation ends (8), the discrimination is made at step S162 as to whether or not the duty heating operation is carried out after the actuation of the main switch. If no duty heating operation has been carried out, the waiting counter of the RAM 106 is cleared at step S163, and the counting operation thereof is started at step S165. Then, the printing period is counted at step S167. Thus, the print counting operation for counting the printing period is continued at each of the key interval interruptions (every 8 msec) when the printing instructions are produced.

At step S169, the discrimination is made on the basis of the count of the waiting counter of the RAM 106 as to whether or not the print waiting period is not less than 10 sec. If not, the further discrimination is made as to whether or not the printing instructions are produced, at step S171. If not, the interval heating operation is started at step S173 (for example, the point of time (8) and the subsequent period). The interval heating operation is similar to the above-described initial heating operation, the pre-heating operation or the line heating operation, and therefore, the detailed descriptions are omitted. The interval heating operations include the discriminations as to the timing for the start and end of this operation, and the start and end of the sub-heating operation.

If the outcome of the discrimination at step S171 is on, that is, there are printing instructions for the second and/or the subsequent lines, the discrimination is made as to whether or not it is the timing for the start of the line heating, at step S175, similarly to the operation subsequent to the step S149. If so, the sub-heating operation is started at step S177 (9), and the line heating period is counted at step S179. The printing period is counted up at step S181, and the operation returns to the main process. If it is not the timing for the start of the line heating operation, and if the line heating operation has not ended, at step S183, the operations of the steps S179 and S181 are carried out, and the operation returns to the main process. As described in the foregoing, the interval heating operation is carried out during the waiting period, so that the second and the subsequent printing operations can be started only with the line heating operation without the preheating operation.

If the end of the line heat is discriminated at step S183, the sub-heating operation is stopped at step S185, and the discrimination is made at step S187 as to whether or not the printing operation for one line is finished. If not, the printing period is counted at step S181, and thereafter, the operation returns to the main process. If the outcome of the discrimination at step S187 is affirmative, the operation of step S162 is carried out. During the subsequent waiting period, the interval heating operation is carried out at step S173 (point of time (10)).

In FIG. 12, the time scale is changed before and after the point of time (10), for the sake of convenience. The printing period (approximately 1 sec) before the point of time (10) and the interval period (approximately 1 sec) subsequent thereto are substantially equal to the actual periods.

If the past duty heating operation is discriminated at step S162, that is, if the interval heating operation for 10 sec immediately after the end of the printing operation and the subsequent duty heating operations have been carried out in the past, the operation proceeds to step S191. First, the discrimination is made as to whether or not the waiting period is longer than 6 sec. If not, the operation returns to the main process. If so, the further discrimination is made at step S193 as to whether or not the printing instructions are produced. If so, the operation returns to step S175. If not, the duty heating operation subsequent to the step S195 described in the foregoing is carried out (for example, the point of time (12)).

Because of the processing operation subsequent to the step S162, the interval heating operation is carried out for 10 sec after the end of the printing operation, during the print waiting period. After 10 sec elapses, the duty heating operation is carried out. Subsequently thereto, the duty heating operations are carried out for every 6 sec.

The description will be made as to the reason why the duty heating operation is carried out after 10 sec elapses after completion of the printing operation. The interval heating operation is performed in order to prevent significant decreasing of the head temperature immediately after the completion of the printing operation. Therefore, the head temperature decreases if the interval heating operation is carried out for a long period of time then, the preheating operation is always required as the case may be. In view of this, if the waiting period is long, the duty heating operation supplying greater energy, rather than the interval heating operation, is carried out to prevent the decrease of the head temperature.

FIG. 11 shows details of the temperature detecting and temperature correcting operations at step S103. In this operation, the temperature is detected by the temperature sensor 124 at step S301. At step S303, the discrimination is made as to whether or not it is the timing for determining the rank which is one of the parameters for looking up the table shown in FIG. 13. In this embodiment, the temperature is detected at step S301 whenever the key interval interruption process is started at every 8 msec. Each time the data for 40 temperature detections are supplied, the rank is determined, so that the average of the temperature detected in the past 320 msec (40 interruptions) is obtained and is used as the base for the determination of the rank. If it is not the timing for the determination of the rank, the detected temperature is stored in the work area of the RAM 106, at step 305. Then, the operation ends.

Figure 14:
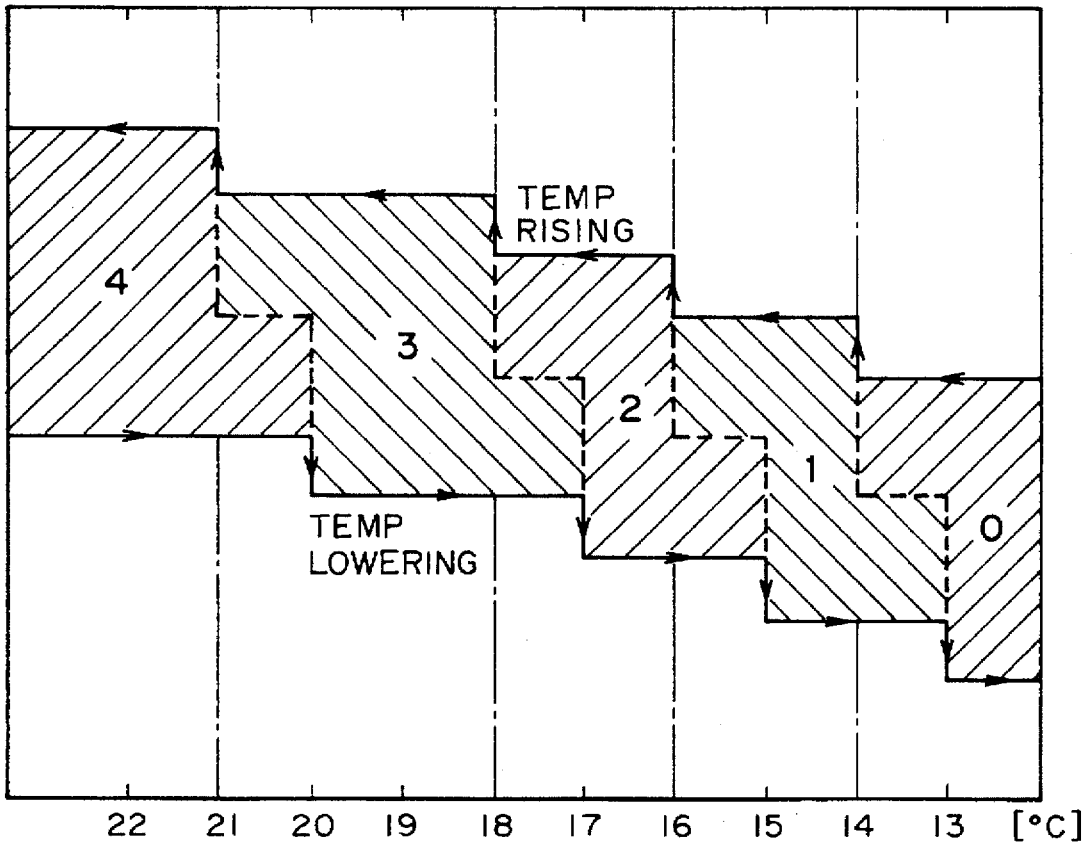
FIG. 14 illustrates a table used when a rank is determined on the basis of the detected temperature in the sub-heat control operation.

If the discrimination at step S303 is affirmative, the average temperature for the past 40 detections is stored in the register A in the work area of the RAM 106, at step S309. At step S311, the temperature stored in the register A is compared with the temperature stored in the register B storing the immediately previous average temperature. If the temperature in the register A is lower, the decreasing temperature table of FIG. 14 is referred to in the determination of the rank. If the temperature in the register A is higher, the temperature increasing table is referred to in the determination of the rank.

At step S315, the content in the register A is shifted into the register B, at step S315. At step S317, the past average temperature of the past 40 detections is cleared, and the operation of this flow chart ends.

FIG. 15 is a flow chart showing the details of the operation for reading data from the disk at step S910 in FIG. 9. When this operation starts (point of time (13)), the file name is read at step S1501, and a message indicates that the reading operation is carried out, at step S1502. For the purpose of concentration on the disk operation, the interruption by the LCDC timer, the first timer and the second timer becomes unacceptable, at step S1503. In addition, at step S1504, the key interval interruption becomes unacceptable. At this time, the waiting counter is cleared. At step S1505, the directory of the document file name inputted is read out. At step S1506, the acceptance of the key interval interruption is enabled, and thereafter, at step S1507, the discrimination is made as to whether or not the reading of the document data is completed. On the basis of the sector information, are file allocation table (FAT) is referred to, and the discrimination is made as to whether or not this is the final sector of the document data. By doing so, if the document file has only the directory but does not have any data therein, the document data is not read out on the basis of the discrimination at step S1507. And the end of the data is discriminated. Then, the operation proceeds to step S1514.

If the discrimination at step S1507 turns out negative, the discrimination is made as to whether or not an error occurs at step S1508. If so, the error clearance operation is executed at step S1513. At step S1514, the end of the reading from the disk is displayed. This is the end of the operation.

If the result of the discrimination at step S1508 is negative, the FAT is searched at step S1509, so that the sector information subsequent to the current sector information is obtained. On the basis of the sector information, the key interval interruption acceptance is prohibited at step S1510. Thereafter, the document data of this sector is read out and stored in the FDD buffer of the RAM 106, at step S1511. Subsequently, the key interval interruption acceptance is enabled at step S1512. Then, the operations after the step S1507 are repeated until the sector information is for the end of the document file. The operation ends through step S1514.

In the foregoing embodiments, the temperature keeping heater is in the form of a heater different and separate from the ejection heaters, but the temperature keeping heater may be in the form of the same structure as the ejection heater, or may be the ejection heaters themselves to which a driving pulse insufficient to eject the ink is supplied to produce heat for the purpose of the temperature maintenance.

In the foregoing embodiment, the recording apparatus is in the form of an electronic typewriter, but the present invention is applicable to any apparatus if it produces an interruption signal for accepting key input at the predetermined intervals as in a wordprocessor or the like.

In such cases, the sub-heating timer is used for dual or more purposes.

In the foregoing embodiments, the recovery operation such as preliminary ejection or sucking operation effected at proper times during the printing operation, is not particularly taken into account, because the preliminary ejection is the same as the usual printing operation since the ejection heater is driven and because although the ejection heaters are not driven during the sucking operation, the head temperature hardly decreases because of the relation among the capacity of the common liquid chamber, the thermal capacity of the heater board and the amount of the sucking ink. By effecting the preliminary ejection after the sucking recovery, the decrease of the head temperature can be suppressed.

Another embodiment of the present invention will be described. Before describing the structure of the apparatus of this embodiment, the operation thereof will be briefly described. In this embodiment, two kinds of duty heat control are provided for the sub-heating operation. One of them is a low duty heat which is low but high enough to maintain the temperature which has been increased by the sub-heating operation during the stand-by period after the recording or increased by the ink ejection heater accumulation during the recording operation. The other is high duty heat which provides high energy to quickly increase the temperature from the low temperature immediately after the main switch actuation or before start of the recording operation.

In the duty heat operation, the heating and temperature keeping heater is supplied with pulse signals, and therefore, is supplied with the energy intermittently, and therefore, the temperature of the heater gradually increases even if the high energy is applied by the high duty heating operation. For this reason, the thermal stress in the heater is small. By doing so, the high energy application to the recording head is prevented even if the actuation and deactuation of the main switch is unusually repeated as described hereinbefore. Therefore, the problems resulting from the repeated actuation or the deactuation can be solved.

In the high duty heating operation supplying the high energy, the temperature of the recording head may increase to an extreme extent if it is carried out for a long period. In order to prevent this, there is provided a limit in the number of pulse drives. If the number exceeds the limit, the low duty heating operation is carried out in place thereof. After even one recording operation is executed, the heaters at the ink ejecting portion accumulate the heat because of the sub-heating control operation or the like, and therefore, if the high duty heating operation is carried out with this state, the recording head temperature will increase to an extreme extent. Therefore, in such a case the low duty heating operation providing the lower energy than the high duty heating operation, is carried out.

The sub-heating operation control in this embodiment will be described. The sub-heating operation control of this embodiment includes (1) initial heating executed upon actuation of the main switch, (2) pre-heating executed after the actuation of the main switch and immediately before the first recording operation, (3) line heating executed for each line recording, (4) interval heating executed during short rest period between line recording operations to maintain the constant temperature of the recording head 9*a*, and (5) low duty heating and high duty heating, the former being executed subsequent to the interval heating operation for a predetermined period of time during waiting period after completion of recording operation to maintain the temperature of the recording head 9*a*, with smaller energy than the interval heating operation, the latter being executed to quickly increase the temperature of the recording head 9*a* after the actuation of the main switch and before the execution of the recording operation. Therefore, it includes 5 kinds of sub-heating control operations.

Figure 16:
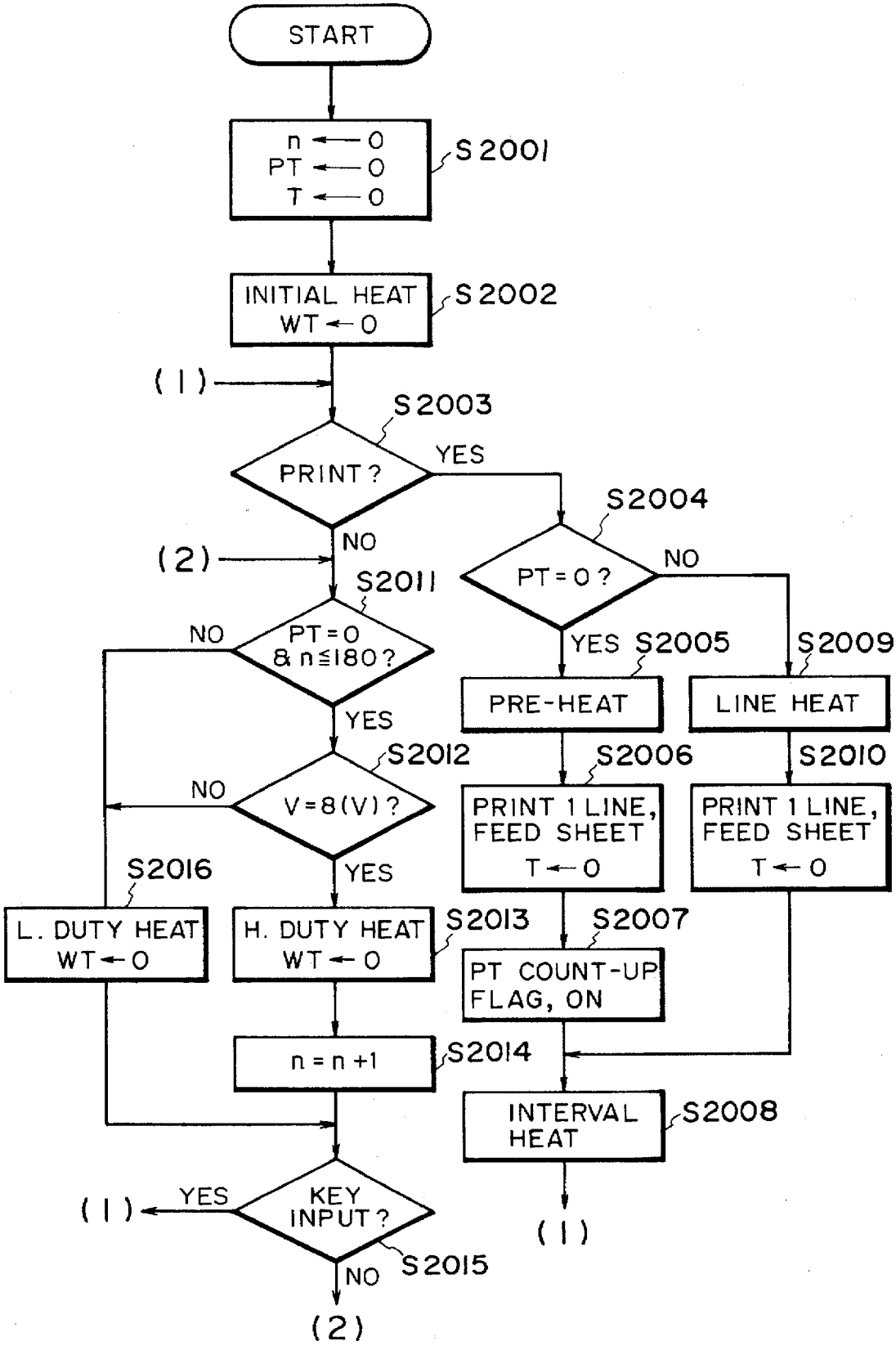
FIG. 16 is a flow chart illustrating control operation in an electronic typewriter according to an embodiment of the present invention.
Figure 17:
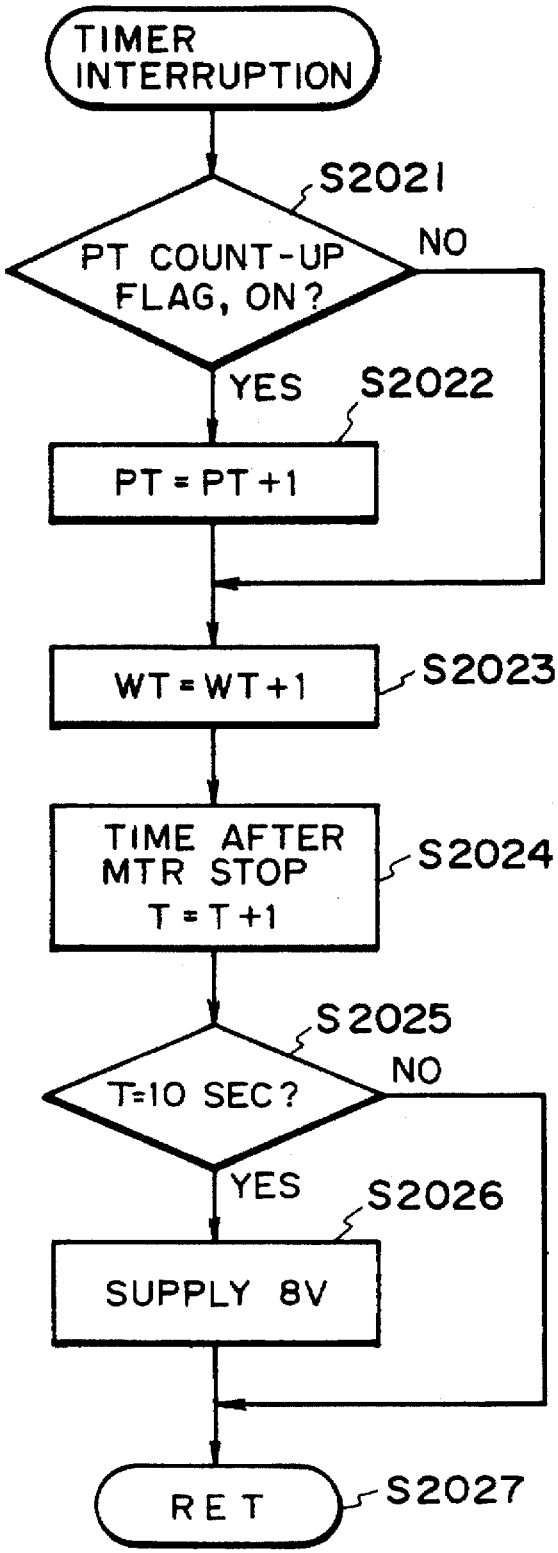
FIG. 17 is a flow chart illustrating interrupting operation in an electronic typewriter according to an embodiment of the present invention.

Referring to FIGS. 16 and 17, there are shown fundamental flow charts of the sub-heat control operations.

The program for this processing is started upon actuation of the main switch of the electronic typewriter of this embodiment. At step S2001, a counter n, print timer PT, a timer T for counting the time period after actuation of the motor, a print timer count-up flag or the like, are cleared to "0". Here, n is the number of executions of the applied pulses by the high duty heating operation which will be described hereinafter. The count of the print timer PT represents the time period from the start of the first recording operation after the actuation of the main switch. Thus, the count of the print timer is a parameter representing the state of heat accumulation of the ink ejection heater 112. Therefore, the larger count means the larger heat accumulation in the recording head 9*a*. Then, the operation proceeds to step S2002 to execute the initial heating operation, during which the pulses having a predetermined voltage level and a predetermined time width are applied in accordance with a sub-heat control data shown in FIG. 18.

The description will be made as to the sub-heat data shown in FIG. 18. By a temperature sensor 124 disposed in the main assembly of the ink jet printer, the ambient temperature of the recording head is detected. There are provided 5 ranks of the sub-heating operations, which are selected in accordance with the detected temperature. More particularly, rank 0 is used for not more than 14° C.; rank 1 is for 14°–16° C.; rank 2 is for 16°–18° C.; rank 3 is for 18°–21° C.; and rank 4 is for not less than 21° C. In order to increase the applied energy with decrease of the ambient temperature of the recording head 9*a*, the pulse signal term is made longer with the decrease of the ambient temperature. The voltage applied to the temperature keeping heater 128 for the recording head 9*a*, is uniformly 18 V in the initial heating, pre-heating, line heating and interval heating operations. This is because the voltage source is common for the motors and sub-heat operations, and therefore, the sub-heating operations carried out simultaneously with the motor drive, are effected with such a pulse term that the proper energy is applied to the recording head when the voltage for driving the motors is 18 V.

On the other hand, for the duty heating operation, a table for 8 V and a Table for 18 V are provided. The reason for this is as follows. In the ink jet recording station of the electronic typewriter, The entire supply voltage is lowered from 18 V to 8 V when a predetermined period of time (approx. 10 sec in this embodiment) elapses from stop of all of the motors. This is done for the purpose of safety. Since the duty heating operation is carried out when the voltage is 18 V or 8 V, the two tables are provided.

When the temperature rank is 4 (not less than 21° C.), the sub-heating operation is executed, but the pulse term is "0", so that the temperature keeping heater 128 is not heated.

The operation returns to step S2002 of FIG. 16, one pulse signal having a pulse term corresponding to the ambient temperature of the recording head 9*a* is applied to the temperature keeping heater 128, and the operation ends. Then, the operation proceeds to step S2003, where the discrimination is made as to whether the recording (printing) instructions are produced or not. If so, step S2004 is carried out. If not, the operation proceeds to step S2011. At step S2004, if the supplied voltage is low (8 V), the voltage is increased to 18 V, and the discrimination is made as to whether the count of the print timer PT is "0". If so, no recording operation has been carried out as yet, and the operation proceeds to step S2005 to carry out the pre-heating operation.

The pre-heating operation is carried out in accordance with the ambient temperature of the recording head on the basis of the pre-heat data shown in FIG. 18. Here, the description will be made as to a waiting period WT which is a factor influential to the pulse width during the pre-heating operation. The pre-heating is originally designed to apply high energy (WT=4–6 sec in FIG. 18) in order to quickly increase the temperature of the ejection heater 112 immediately before the start of the recording operation. However, if the pre-heat pulse (WT=4–6 sec) is applied after the initial heat application, without rest period therebetween, the applied energy is too large. Similarly to this, the energy applied to the recording head 9*a* becomes too large if the pre-heat (WT=4–6 sec) is executed after the application of the duty heat, without the rest period therebetween. In view of these, the time period (WT) is detected from the termination of the initial heat application or the duty heat application, and the pulse width for the pre-heating is determined in accordance with the WT taken at the instance of the pre-heat actuation. By doing so, the low energy is applied when the time period is short from the pulse signal application to the ejection heater 112 to that instance, and a high energy is applied if the period is long. The maximum of the waiting time WT is 6 sec, because the off time of the duty heat which will be described hereinafter is 6 sec. If it exceeds 6 sec, the next pulse application is started.

After one pulse pre-heating operation is executed at the step S2005, the operation proceeds to a step S2006, where the motion of the carriage 11 is started, and the ejection heaters 112 are driven to eject the ink to effect one line recording. After the one line recording is completed, the sheet feeding motor 35 is driven to feed the recording sheet corresponding to the record width. Simultaneously, the count T is reset to "0". Then, the operation proceeds to step S2007, and the PT count flag for starting the PT count is actuated. Then, the operation proceeds to step S2008 to execute the interval heating operation.

The interval heating operation is determined, as shown in FIG. 18, the temperature rank detected by the temperature sensor 124 and the value PT, and as described hereinbefore, when the heat accumulation of the ink ejection heater 112 is small, high energy is applied, whereas when it is large, low energy is applied.

In the interval heating operation, a signal having a pulse width shown in FIG. 18 (maximum 10 sec) is applied during a rest period after recording operation completion and before the next recording operation start, and the application is shut-off for one sec, and they are repeated. If the record instructions are produced during the interval heating operation, the interval heating operation is interrupted, and the next sequential operations are executed (steps S2003–S2004–S2009, which will be described hereinafter). On the other hand, if the print rest state continues after 10 sec execution, the duty heating sequential operations are carried out which will be described hereinafter with steps S2011 and so on.

If, on the other hand, the result of the discrimination at step S2004 is negative (PT is not zero), it means that at least one recording operation is carried out after the main switch is actuated. Therefore, the operation proceeds to step S2009 without execution of the pre-heating operation, and the line heating operation is carried out. In this operation, immediately before the start of the recording operation, one pulse having a width (FIG. 18) in accordance with the count of the print timer PT and the temperature rank as in the case of the interval heating operation, is applied to the temperature keeping heater 128. At step S2010, similarly to the step S2006, one line recording is carried out, and the count of the timer T is reset to "0". Then, the operation proceeds to step S2008 to execute the interval heating operation.

If the record (print) instructions are not produced at step S2003, the operation proceeds to a step S2011 where the discrimination is made as to whether or not PT is zero and whether or not n≦180. If so, the operation proceeds to step S2012, where the discrimination is made as to whether the driving voltage for the ejection heater 112 is 8 V or not. If it is 8 V, the operation proceeds to step S2013, where the high duty heating operation is carried out. This case means that the recording operation has not yet been executed after the main switch is actuated and that the number of high duty heating pulses applied is less than "180". In other words, high energy application is required, and it is safe even if the high energy is applied to the temperature keeping heater 128.

The upper limit of n is determined to be 180 for the following reasons. Similarly to the time periods of the other sub-heat control data shown in FIG. 18, it is empirically determined such that the temperature does not become too high. The high duty heat operation is carried out only when V=8 V for the following reasons. As described hereinbefore, the driving voltage for the entirety of the ink jet recorder is switched to 8 V during the rest period. At almost all of the times when the high duty heating operation is required, the voltage is 8 V for the rest period, and therefore, the voltage is limited to 8 V for the purpose of simplicity of the control system.

In the duty heating operation, the pulse having the pulse width determined in accordance with the temperature rank is applied for the time period shown in FIG. 18, until the next recording operation is started, and then, the pulse application is shut-off for 6 sec, and the pulse heating is executed again. These operations are repeated. After the high duty heating pulse application at step S2013, the waiting timer WT is cleared to "0". At step S2014, the value n is counted up to provide integrated pulse number applied. The reason for the limit for the execution of the high duty heating operation is as follows. As described hereinbefore, the high duty heating operation applies high energy, and therefore, if it is executed for a long period, the temperature of the ejection heaters 112 increases too much, with the possible result of damage of the recording head 9*a*. As for another means for detecting the limit, an additional timer may be used to count the time.

If, on the other hand, the result of the discrimination at step S2011 is negative, that is, if at least one recording operation has been executed already or if the number of applied pulses in the high duty heating operation exceeds 180, it means that the high energy application is not required or that there is a possibility of the too high temperature rise. Therefore, the operation proceeds to step S2016 to execute the low duty heating operation with the pulse of low energy. Here, the current voltage level (18 V or 8 V) is discriminated, and in accordance with the detected voltage level, the application period is determined in accordance with the data table shown in FIG. 18. The low duty heat with 8 V and that with 18 V apply the same level energy.

After the duty heating operation executed at steps S2013 and S2016, the waiting period timer WT is reset to "0".

After the operations in step S2014 and S2016, the operation proceeds to step S2015, where the discrimination is made as to whether or not there is next key input on the keyboard 1 or not. If not, that is, if there is no key input, or it is not recording instructions, the operation proceeds to the step S2011 described hereinafter to repeat the duty heating operations routine (one pulse actuation with 6 sec rest interval). On the other hand, the discrimination at step S2015 means the existence of key input and the recording instruction, the operation proceeds to steps S2003 and S2004 to carry out the recording operation.

FIG. 17 is a flow chart illustrating an interruption operation occurring at predetermined intervals determined by a timer. By the interruption operation, the print timer PT, waiting period timer (WT) and the timer T for counting the time period after the stoppage of the motor, are renewed.

When the interruption occurs, the operation proceeds to step S2021, and the discrimination is made as to whether the PT count up flag is on or not. If so, the operation proceeds to step S2022, where the PT is incremented by +1. Next, at step S2023, WT count is incremented by +1. At step S2024, the timer T for counting the time period after stoppage of the motor is incremented by +1. Then, the operation proceeds to step S2025, where the investigation is made whether the count of the timer T has become 10 sec. When it becomes 10 sec, the operation proceeds to step S2026, where the voltage source controller 130 decreases the supply voltage from 18 V to 8 V.

Figure 19:
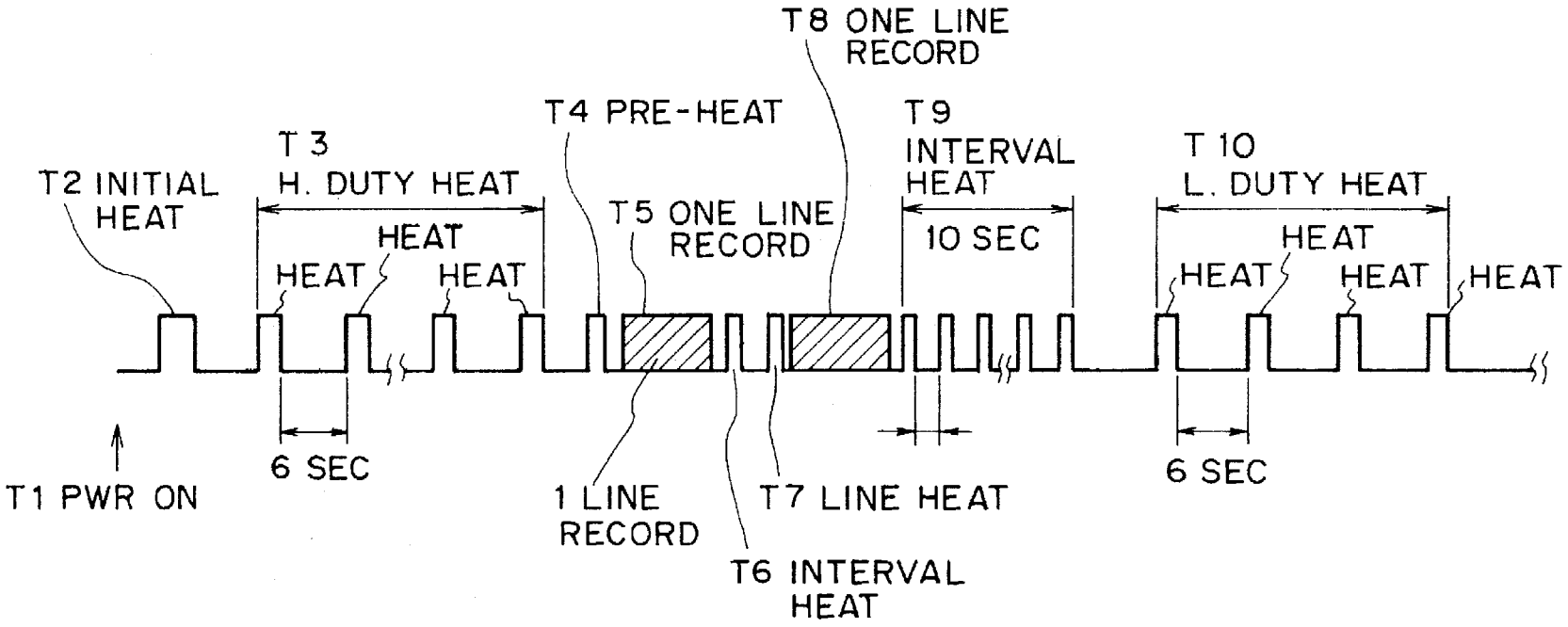
FIG. 19 is a time chart of an example of a sub-heating operation in an electronic typewriter according to an embodiment of the present invention.

FIG. 19 shows electric power supply timing to the recording head 9*a* (ejection heater 112) executed in accordance with the flow chart shown in FIGS. 16 and 17.

When the main switch is actuated at time T1 in FIG. 19, one pulse is applied to execute the initial heating operation at time T2 (step S2002 of FIG. 16). Thereafter, the operation is shown for the case not proceeding to the recording operation (step S2011 and the subsequent steps in FIG. 16). In this case, the high duty heating operation is carried out at time T3. In the high duty heating operation contains one pulse heating and the subsequent 6 sec off time, and the operation is repeated until the printing instructions are produced.

When the recording instructions are produced at step S2003 in FIG. 16, the pre-heating operation is carried out at timing T4 (step S2005 of FIG. 16). Subsequently, at time T5, the one line recording operation is carried out (step S2006). When the one line recording is completed in this manner, the interval heating operation is executed at timing T6 (step S2008).

When the interval heating operation is carried out indicated by the timing T6, the sheet feeding motor 35 is rotated to feed the recording sheet during the time between adjacent one line recordings (not shown).

When the printing instructions are produced continuously, the line heating operation is executed at time T7 (step S2009), the next one line recording operation is carried out at time T8 (step S2010). In the Figure, the next recording operation is not instructed at time T9, and therefore, the interval heating operation is carried out for 10 sec. During the interval heating operation, there is 1 sec off time between one pulse heating application and the next pulse heat application. They are repeated. Thereafter, when the recording instructions are still not produced, the low duty heating operation is repeated at time T10 (step S2016). This is for the case in which the operation proceeds in the order of step S2003, step S2011, step S2016 in FIG. 16. Similarly to the high duty heating operation at step S2013, there is 6 sec off time between one pulse heat application and the next pulse heat application. They are repetitively carried out.

In the foregoing embodiment, the high duty heating operation is limited to the time when V=8 V. However, similarly to the low duty heating operation, the high duty heating operation may be executed when the voltage is 18 V.

In this case, the heating data table is made as shown in FIG. 18 to provide the same energy level, so that the high duty heating operation can be carried out when the voltage is 18 V.

In the foregoing embodiment, only one limit is provided for the number of high duty heat operations. However, since the one pulse heating period is different in accordance with the temperature rank detected by the temperature sensor 124, the high duty heating operation execution time becomes slightly different depending on the temperature rank if the same number of limit operations are executed. To remove the difference, it is possible that the limit of the number is different depending on the temperature rank so that the high duty heat execution time is constant irrespective of the temperature rank.

This invention is applicable to a system constituted by plural machines, or it may be applied to one machine. The present invention may be embodied by supplying a program to the system or the machine.

As described in the foregoing, according to the embodiment, the pre-heating operation is possible with high energy gradually applied to the recording head immediately after the actuation of the main switch, and therefore, the safe and effective temperature rise can be provided. In addition, even under the low temperature condition, the ink ejection property is maintained satisfactory with low cost.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the abovementioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As will be understood from the foregoing description, according to the present invention, the duty heat drive is periodically effected when the predetermined period is exceeded during the print waiting period, and therefore, the necessity for the preheating operation is eliminated, or the preheating drive period can be reduced. As a result, the response to the printing instructions is improved, that is, the time between the production of the printing instruction to the start of the printing is decreased.

According to the present invention, the counting operations by the print counter and the waiting counter for controlling the heating element driving period in the sub-heating control and the timing for various control operations, can be controlled on the basis of the key interval interruption. As a result, the structure of the timer for the interruption is simplified.

Furthermore, according to the present invention, the temperature detection process, the temperature smoothing process for the detected temperature and the class or rank determination process for the smoothed temperature can be carried out on the basis of the key interval interruption for accepting the key input. As a result, the timer structure is further simplified.

Additionally, according to the present invention, a common power source is used for the carriage drive and the sub-heating drive. The tables for the sub-heating drives are provided for the respective power source voltages selectively used in the carriage movement mode. Accordingly, the structure of the power source is simplified while the sub-heating control is effectively carried out.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus for recording an image on a recording material, the apparatus comprising:

record control means for controlling a recording head to effect a recording operation;

a heat generating element for controlling a temperature of the recording head;

driving means for driving said heat generating element to generate heat; and control means for controlling said driving means to generate heat with said heat generating element with plural steps, each generating heat a plurality of times in a predetermined heat generating period, after completion of a recording operation, wherein energy applied to said heat generating element in a later step is smaller than energy applied to said heat generating element in an earlier step.

2. An apparatus according to claim 1, wherein a heat generating cycle in a later step is longer than a heat generating cycle in an earlier step.

3. An apparatus according to claim 1, wherein said control means permits drive of said heat generating element to generate heat after actuation of a main switch of said recording apparatus and before start of a recording operation.

4. An apparatus according to claim 3, wherein energy applied to said heat generating element before starting a recording operation is larger than energy applied to said heat generating element in a later step.

5. An apparatus according to claim 1, further comprising counting means for counting a number of pulse drives in heating steps executed prior to the start of the recording operation, wherein when the number exceeds a predetermined number, said control means controls said driving means so that energy applied to said heat generating element in subsequent heat generating steps is smaller than energy applied to said heat generating element in a heat generating step executed before the start of a recording operation.

6. An apparatus according to claim 3, wherein said control means controls said driving means so that energy applied to said heat generating element in a heat generating step after the start of a recording operation is smaller than energy applied to said heat generating element in a heat generating step executed before the start of the recording operation.

7. An apparatus according to claim 1, wherein said driving means pulsewisely drives said heat generating element.

8. An apparatus according to claim 1, further comprising temperature detecting means for detecting a temperature relating to said recording head, wherein said control means drives said driving means in accordance with temperature information detected by said temperature detecting means.

9. An apparatus according to claim 8, further comprising memory means for storing a driving condition with which said heat generating element is driven in accordance with temperature information detected by said temperature detecting means, wherein said control means controls said driving means in accordance with the driving condition.

10. An apparatus according to claim 1, wherein said recording head comprises an ink jet recording head for ejecting ink for recording.

11. An apparatus according to claim 10, wherein said recording head uses thermal energy to eject the ink and includes an energy transducer for generating thermal energy to be applied to the ink.

12. An apparatus according to claim 11, wherein said energy transducer causes a state change in the ink to eject the ink through an ejection outlet.

13. A recording apparatus according to claim 1, further comprising a recording element for recording the image, said recording element being different from said heat generating element.

14. A recording apparatus for recording an image on a recording material, the apparatus comprising:

record control means for controlling a recording head to effect a recording operation;

a heat generating element for controlling a temperature of the recording head;

driving means for driving said heat generating element to generate heat; and control means for controlling said driving means to drive said heat generating element with a first step after actuation of a main switch of said recording apparatus and before start of a recording operation and thereafter to drive said heat generating element with a second step, heat being generated in each of said first step and said second step a plurality of times in a predetermined heat generating period, wherein energy applied to said heat generating element in said second step is smaller than energy applied to said heat generating element in said first step.

15. An apparatus according to claim 14, wherein said driving means pulsewisely drives said heat generating element.

16. An apparatus according to claim 15, further comprising counting means for counting a number of pulse drives in said first step, wherein said control means controls said driving means to permit said second step to be carried out when the number of pulses reaches a predetermined number.

17. An apparatus according to claim 14, wherein said control means controls said driving means to permit said second step to be carried out when a recording operation is started.

18. An apparatus according to claim 14, wherein said recording head comprises an ink jet recording head for ejecting ink for recording.

19. An apparatus according to claim 18, wherein said recording head uses thermal energy to eject the ink and includes an energy transducer for generating thermal energy to be applied to the ink.

20. An apparatus according to claim 19, wherein said energy transducer causes a state change in the ink to eject the ink through an ejection outlet.

21. A recording apparatus according to claim 14, further comprising a recording element for recording the image, said recording element being different from said heat generating element.

22. A recording method for recording an image on a recording material, the method comprising the steps of:

recording with a recording head; and performing a plurality of heat generating steps after said recording step by actuating a heat generating element for controlling the temperature of the recording head plural times so that heat is generated in each heat generating step a plurality of times in a predetermined heat generating period, wherein energy applied to said heat generating element in a later step is smaller than energy applied to said heat generating element in an earlier step.

23. An apparatus according to claim 22, wherein the recording head comprises an ink jet recording head for ejecting ink for recording.

24. An apparatus according to claim 23, wherein the recording head uses thermal energy to eject the ink and includes an energy transducer for generating thermal energy to be applied to the ink.

25. An apparatus according to claim 24, wherein the energy transducer causes a state change in the ink to eject the ink through an ejection outlet.

26. A recording method for recording an image on a recording material, the method comprising the steps of:

actuating a main switch of a recording apparatus;

performing a first heat generating step after actuation of the main switch by driving a heat generating element for controlling a temperature of a recording head to generate heat before start of a recording operation;

performing a second heat generating step when a predetermined condition is satisfied after said first heat generating step, wherein energy applied to the heat generating element in said second heat generating step is smaller than the energy applied to the heat generating element in said first heat generating step, and the heat generating element is driven in each of said first heat generating step and said second heat generating step to generate heat a plurality of times in a predetermined heat generating period; and recording using the recording head at least after said first heat generating step.

27. An apparatus according to claim 26, wherein the recording head comprises an ink jet recording head for ejecting ink for recording.

28. An apparatus according to claim 27, wherein said recording head uses thermal energy to eject the ink and includes an energy transducer for generating thermal energy to be applied to the ink.

29. An apparatus according to claim 28, wherein the energy transducer causes a state change in the ink to eject the ink through an ejection outlet.

30. A method according to claim 26, wherein the recording head has a recording element for recording the image which is different from the heat generating element.

31. A recording apparatus for recording an image on a recording material, the apparatus comprising:

record control means for controlling a recording head to effect a recording operation;

a heat generating element for controlling a temperature of the recording head;

driving means for pulsewisely driving said heat generating element to generate heat;

control means for controlling said driving means to generate heat with said heat generating element with plural steps, each having a predetermined heat generating period, after completion of a recording operation; and counting means for counting a number of pulse drives in heating steps executed prior to the start of the recording operation, wherein when the number exceeds a predetermined number, said control means controls said driving means so that energy applied to said heat generating element in subsequent heat generating steps is smaller than energy applied to said heat generating element in a heat generating step executed before the start of a recording operation.

32. A recording apparatus for recording an image on a recording material, the apparatus comprising:

record control means for controlling a recording head to effect a recording operation;

a heat generating element for controlling a temperature of the recording head;

driving means for pulsewisely driving said heat generating element to generate heat;

control means for controlling said driving means to drive said heat generating element with a first step after actuation of a main switch of said recording apparatus and before start of a recording operation and thereafter to drive said heat generating element with a second step; and counting means for counting a number of pulse drives in said first step, wherein said control means controls said driving means to permit said second step to be carried out when the number of pulses reaches a predetermined number and energy applied to said heat generating element in said second step is smaller than energy applied to said heat generating element in said first step.

* * * * *

UNITED STATES PATENT AND TRADEMARK OFFICE

CERTIFICATE OF CORRECTION

PATENT NO. : 5,689,292

DATED : November 18, 1997

INVENTOR(S): NAOHISA SUZUKI ET AL.

It is certified that error appears in the above-identified patent and that said Letters Patent is hereby corrected as shown below:

COLUMN 1

Line 12, "to a" should read --to an--;
Line 19, "in a" should read --in--.

COLUMN 2

Line 50, "since" should be deleted.

COLUMN 3

Line 22, "operation" should read --operations--;
Line 60, "periods." should read --period.--;
Line 65, "is" should read --are--.

COLUMN 4

Figure 5A:
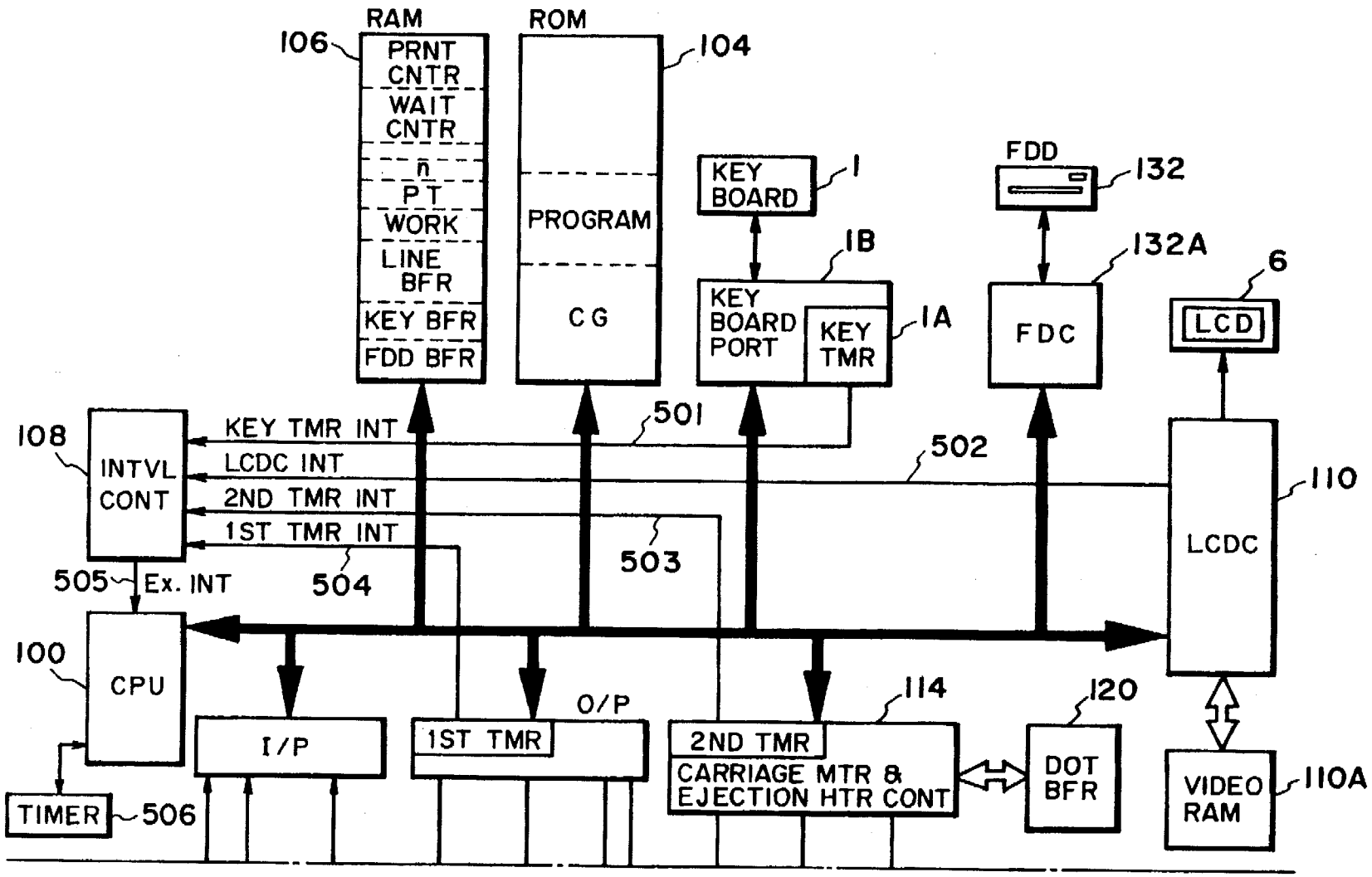

Line 1, "with" should read --within--;
Line 35, "a" should read --of a--;
Line 40, before the line, insert --FIG. 5 is a block diagram showing that FIGS. 5A and 5B are to be read as connected diagrams.-- and "combined is" should read --combined are--.

COLUMN 5

Line 31, "(LID)" should read --(LCD)--.

UNITED STATES PATENT AND TRADEMARK OFFICE

CERTIFICATE OF CORRECTION

PATENT NO. : 5,689,292

DATED : November 18, 1997

INVENTOR(S): NAOHISA SUZUKI ET AL.

It is certified that error appears in the above-identified patent and that said Letters Patent is hereby corrected as shown below:

COLUMN 6

Line 33, "a" should read --an--.

COLUMN 8

Line 5, "gasket" should read --gaskets--;
Line 50, "comprises" should read --comprise--;
Line 59, after "port" add --causes--.

COLUMN 9

Line 15, "diodes" should read --are diodes--.

COLUMN 10

Line 20, "of" should read --of the--.

COLUMN 12

Line 4, "operations." should read --operation.--;
Line 7, "steps" should read --step--.

COLUMN 15

Line 14, "indicates" should read --is displayed--;
Line 25, "are" should be deleted.

UNITED STATES PATENT AND TRADEMARK OFFICE

CERTIFICATE OF CORRECTION

PATENT NO. : 5,689,292

DATED : November 18, 1997

INVENTOR(S): NAOHISA SUZUKI ET AL.

It is certified that error appears in the above-identified patent and that said Letters Patent is hereby corrected as shown below:

COLUMN 17

Line 44, "The" should read --the--;
Line 20, "FIG. 18." should read --FIGS. 18A-18E.--.

COLUMN 18

Line 3, "FIG. 18." should read --FIGS. 18A-18E.--;
Line 10, "rest" should read --the--.
Line 14, "pre-heat" should read --pre-heat pulse--.

COLUMN 19

Line 14, ""180"." should read --180.--;
Line 65, "or not" should be deleted.

COLUMN 20

Line 32, "In the" should read --The--;
Line 55, "heat" should read --heating--.

COLUMN 21

Line 6, "heat" should read --heating--.

COLUMN 22

Line 51, "is the" should read --in the--.

UNITED STATES PATENT AND TRADEMARK OFFICE

CERTIFICATE OF CORRECTION

PATENT NO. : 5,689,292

DATED : November 18, 1997

INVENTOR(S): NAOHISA SUZUKI ET AL.

It is certified that error appears in the above-identified patent and that said Letters Patent is hereby corrected as shown below:

COLUMN 24

Line 20, "pulsewisely" should read --pulsewise--;
Line 66, "pulsewisely" should read --pulsewise--.

COLUMN 26

Line 23, "pulsewisely" should read --pulsewise--;
Line 46, "pulsewisely" should read --pulsewise--.

Signed and Sealed this

Ninth Day of June, 1998

*Attest:*

*Attesting Officer*

BRUCE LEHMAN

*Commissioner of Patents and Trademarks*